US009539699B2

(12) United States Patent
Shinozaki

(10) Patent No.: US 9,539,699 B2
(45) Date of Patent: Jan. 10, 2017

(54) POLISHING METHOD

(71) Applicant: Ebara Corporation, Tokyo (JP)

(72) Inventor: Hiroyuki Shinozaki, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 14/833,727

(22) Filed: Aug. 24, 2015

(65) Prior Publication Data

US 2016/0074994 A1 Mar. 17, 2016

(30) Foreign Application Priority Data

Aug. 28, 2014 (JP) ..... 2014-174145
Sep. 29, 2014 (JP) ..... 2014-198804

(51) Int. Cl.
*B24B 53/00* (2006.01)
*B24B 53/017* (2012.01)
*B24B 37/04* (2012.01)

(52) U.S. Cl.
CPC ..... *B24B 53/017* (2013.01); *B24B 37/042* (2013.01)

(58) Field of Classification Search
CPC . B24B 53/017; B24B 37/042; H01L 21/67051
USPC ..... 451/59, 444; 134/144, 148, 151, 153, 134/157, 198–200
See application file for complete search history.

(56) References Cited

U.S. PATENT DOCUMENTS 4,100,507 A * 7/1978 Born ..... H01S 3/0953 372/35
5,545,076 A * 8/1996 Yun ..... B08B 3/02 134/148
6,245,677 B1 * 6/2001 Haq ..... B24B 37/042 257/E21.219
6,293,855 B1 * 9/2001 Yoshida ..... B24B 37/04 451/287
6,319,105 B1 * 11/2001 Togawa ..... B24B 53/017 134/153
6,402,598 B1 * 6/2002 Ahn ..... H01L 21/67051 451/288

(Continued)

FOREIGN PATENT DOCUMENTS

JP 2005-123485 A 5/2005
JP 2010-046756 A 3/2010

(Continued)

*Primary Examiner* — George Nguyen
(74) *Attorney, Agent, or Firm* — Leydig, Voit & Mayer, Ltd.

(57) ABSTRACT

A polishing method which can prevent a contamination of a release nozzle for releasing a substrate, such as a wafer, from a polishing head, is disclosed. The polishing method includes: polishing a substrate by pressing the substrate against a polishing pad on a polishing table by a polishing head while moving the polishing table and the polishing head relative to each other; moving the polishing head, holding the substrate, to a predetermined position above a substrate transfer device; cleaning the substrate by ejecting a cleaning fluid onto the substrate held by the polishing head located at the predetermined position; during cleaning of the substrate, discharging a fluid from a release nozzle located at the substrate transfer device; and after cleaning of the substrate, releasing the substrate from the polishing head by ejecting a releasing shower from the release nozzle into a gap between the polishing head and the substrate.

20 Claims, 29 Drawing Sheets

(56) References Cited

U.S. PATENT DOCUMENTS

| | | | | |
|---|---|---|---|---|
| 6,659,116 | B1 * | 12/2003 | Williams | B08B 3/02 134/176 |
| 6,726,777 | B1 * | 4/2004 | Sonoda | B08B 3/022 134/198 |
| 6,878,044 | B2 * | 4/2005 | Sakurai | B24B 37/042 257/E21.23 |
| 7,942,725 | B2 | 5/2011 | Torii et al. | |
| 9,362,129 | B2 * | 6/2016 | Miyazaki | H01L 21/67051 |
| 2005/0252535 | A1 * | 11/2005 | Nishioka | H01L 21/67051 134/33 |
| 2007/0066184 | A1 * | 3/2007 | Nagamoto | B24B 37/042 451/41 |
| 2007/0141961 | A1 * | 6/2007 | Brown | B24B 9/10 451/44 |
| 2007/0215280 | A1 * | 9/2007 | Sandhu | B24B 37/042 156/345.12 |
| 2008/0031510 | A1 * | 2/2008 | Jung | B24B 37/042 382/149 |
| 2011/0159783 | A1 | 6/2011 | Fukushima et al. | |
| 2011/0195279 | A1 * | 8/2011 | Saeki | B08B 1/04 428/846.9 |
| 2014/0011305 | A1 | 1/2014 | Nakamura | |
| 2014/0162536 | A1 | 6/2014 | Umemoto et al. | |

FOREIGN PATENT DOCUMENTS

| | | | |
|---|---|---|---|
| JP | 2010-242668 | A | 10/2010 |
| JP | 2011-258639 | A | 12/2011 |

* cited by examiner

POLISHING METHOD

CROSS REFERENCE TO RELATED APPLICATIONS

This document claims priorities to Japanese Patent Application Number 2014-174145 filed Aug. 28, 2014 and Japanese Patent Application Number 2014-198804 filed Sep. 29, 2014, the entire contents of which are hereby incorporated by reference.

BACKGROUND

With a recent trend toward higher integration and higher density in semiconductor devices, circuit interconnects become finer and finer and the number of levels in multilayer interconnect is increasing. In the process of achieving the multilayer interconnect structure with finer interconnects, film coverage of step geometry (or step coverage) is lowered through thin film formation as the number of interconnect levels increases, because surface steps grow while following surface irregularities on a lower layer. Therefore, in order to fabricate the multilayer interconnect structure, it is necessary to improve the step coverage and planarize the surface in an appropriate process. Further, since finer optical lithography entails shallower depth of focus, it is necessary to planarize surfaces of semiconductor device so that irregularity steps formed thereon fall within a depth of focus in optical lithography.

Accordingly, in a manufacturing process of the semiconductor devices, a planarization technique of a surface of the semiconductor device is becoming more important. The most important technique in this planarization technique is chemical mechanical polishing. This chemical mechanical polishing (which will be hereinafter called CMP) is a process of polishing a substrate, such as a wafer, by placing the substrate in sliding contact with a polishing pad while supplying a polishing liquid containing abrasive grains, such as silica ($SiO_2$), onto the polishing pad.

A polishing apparatus for performing CMP includes a polishing table that supports a polishing pad having a polishing surface, and a substrate holder, which is referred to as a polishing head or a top ring, for holding a wafer. When the wafer is polished with such a polishing apparatus, the polishing table and the polishing head are moved relative to each other while supplying the polishing liquid (slurry) onto the polishing pad disposed on the polishing table, and the wafer is pressed against the polishing surface of the polishing pad at a predetermined pressure by the polishing head. The wafer is brought into sliding contact with the polishing surface in the presence of the polishing liquid, so that the surface of the wafer is polished to a flat and mirror finish.

In such polishing apparatus, if a relative pressing force applied between the wafer and the polishing surface of the polishing pad during polishing is not uniform over the entirety of the surface of the wafer, insufficient polishing or excessive polishing would occur depending on the pressing forces applied to respective portions of the wafer. Thus, in order to even the pressing force applied to the wafer, the polishing head has a pressure chamber formed by an elastic membrane (or a membrane) at a lower part thereof. This pressure chamber is supplied with a fluid, such as air, to press the wafer against the polishing surface of the polishing pad through the membrane under a fluid pressure, and to polish the wafer.

Since the polishing pad has elasticity, the pressing force applied to an peripheral edge of the wafer during polishing of the wafer, becomes non-uniform, and hence only the peripheral edge of the wafer may excessively be polished, which is referred to as "edge rounding". In order to prevent such edge rounding, a retainer ring for holding the peripheral edge of the wafer is provided so as to press the polishing surface of the polishing pad located at the outer circumferential edge side of the wafer.

A substrate transfer device, which is called a pusher, is disposed near the polishing table. This pusher has a function to elevate the wafer, which has been transported by a transporter, such as a transfer robot, and transfer the wafer to the polishing head that has been moved to a position above the pusher. The pusher further has a function to transfer the wafer, which has been received from the polishing head, to the transporter, such as a transfer robot.

In the polishing apparatus having the above-described structure, the wafer that has been polished on the polishing pad is moved to a position above the pusher by the polishing head. A wafer cleaning operation, a wafer releasing operation, and a polishing-head cleaning operation are then performed above the pusher.

In the wafer cleaning operation, a cleaning fluid, such as pure water, is ejected onto a polished surface of the wafer held by the polishing head, to thereby clean the polished surface of the wafer. After the wafer cleaning operation, the wafer releasing operation for releasing the wafer from the polishing head is performed. The wafer that has been released from the polishing head is received by the pusher and is then transported to a next process (e.g., cleaning of the wafer) by the transporter. After the wafer is released, the polishing-head cleaning operation is performed, in which a cleaning fluid, such as pure water, is ejected onto an outer surface of the polishing head to clean the polishing head, and further a cleaning fluid is ejected onto the membrane of the polishing head to clean a wafer holding surface of the membrane. According to this operation, the entirety of the polishing head including the membrane is cleaned.

Releasing of the wafer in the wafer releasing operation is performed by supplying a fluid into the pressure chamber to deform the wafer holding surface of the membrane. However, if the membrane is not deformed largely, the wafer may not be released from the membrane. Thus, in order to ensure releasing of the wafer from the polishing head, the pusher is provided with a release nozzle. This release nozzle is a device for delivering a jet of fluid (or releasing shower) into a gap between the wafer and the membrane to thereby assist the wafer release.

In the above-described wafer cleaning operation and polishing-head cleaning operation, the cleaning fluid is ejected onto the polishing head when the polishing head is located above the pusher. Therefore, the cleaning fluid, which has been brought into contact with the polishing head and the polished surface of the wafer, flows down onto the pusher. This cleaning fluid contains contaminants, such as abrasive grains and polishing debris which are attached to the polishing head and the wafer. Therefore, upon touching the release nozzle, the cleaning fluid may contaminate the release nozzle. In particular, the cleaning fluid containing the abrasive grains and the polishing debris may be sucked into the release nozzle from an opening thereof due to a capillary action, thus contaminating an interior of the release nozzle.

If the abrasive grains and the polishing debris are attached to the interior and a surface of the release nozzle, these abrasive grains and polishing debris may be attached to a next wafer together with the releasing shower, thus causing a contamination of the next wafer.

The releasing shower can assist the wafer release and can increase a throughput of polishing operation in the polishing apparatus. On the other hand, the releasing shower may hinder the wafer from being released if the releasing shower impinges on the surface (i.e., the polished surface) of the wafer, because the releasing shower is widened at a moment the releasing shower is expelled from a jet orifice of the release nozzle, thus pressing the wafer against the membrane.

In such a case, it has been a conventional solution to increase the pressure of fluid supplied into the pressure chamber of the membrane so as to inflate the membrane largely. When the membrane is largely inflated, the gap formed between the wafer and the membrane becomes larger, so that the releasing shower is less likely to impinge on the surface (the polished surface) of the wafer.

However, when the membrane is largely inflated while the wafer and the membrane are in an intimate contact, a large stress is generated in the wafer, causing a rupture of finer interconnects formed on the wafer or causing breakage of the wafer. Therefore, there is a demand for a technique which can properly eject the releasing shower into the gap between the wafer and the membrane even if the gap is small.

The releasing shower is widened while sucking surrounding particles. As a result, the releasing shower containing such particles is brought into contact with a front surface and a rear surface of the wafer, possibly causing the contamination of the wafer.

SUMMARY OF THE INVENTION

According to an embodiment, there is provided a polishing method which can prevent contamination of a release nozzle for releasing a substrate, such as a wafer, from a polishing head. Further, according to an embodiment, there is provided a polishing method which can properly deliver a jet of a fluid into a gap between a substrate and a membrane even if the gap is small, and does not contaminate the substrate when it is released.

Embodiments, which will be described below, relate to a polishing method and a polishing apparatus, and more particularly to a polishing method and a polishing apparatus for polishing a substrate, such as a wafer.

In an embodiment, there is provided a polishing method comprising: polishing a substrate by pressing the substrate against a polishing pad on a polishing table by a polishing head while moving the polishing table and the polishing head relative to each other; moving the polishing head, holding the substrate, to a predetermined position above a substrate transfer device; cleaning the substrate by ejecting a cleaning fluid onto the substrate held by the polishing head located at the predetermined position; during cleaning of the substrate, discharging a fluid from a release nozzle located at the substrate transfer device; and after cleaning of the substrate, releasing the substrate from the polishing head by ejecting a releasing shower from the release nozzle into a gap between the polishing head and the substrate.

In an embodiment, there is provided a polishing method comprising: polishing a substrate by pressing the substrate against a polishing pad on a polishing table by a polishing head while moving the polishing table and the polishing head relative to each other; moving the polishing head, holding the substrate, to a predetermined position above a substrate transfer device; cleaning the substrate by ejecting a cleaning fluid onto the substrate held by the polishing head located at the predetermined position; during cleaning of the substrate, ejecting a fluid toward a release nozzle located at the substrate transfer device; and after cleaning of the substrate, releasing the substrate from the polishing head by ejecting a releasing shower from the release nozzle into a gap between the polishing head and the substrate.

In an embodiment, there is provided a polishing method comprising: polishing a substrate by pressing the substrate against a polishing pad on a polishing table by a polishing head while moving the polishing table and the polishing head relative to each other; moving the polishing head, holding the substrate, to a predetermined position above a substrate transfer device; moving a shutter to a position above a release nozzle to cover the release nozzle which is located at the substrate transfer device; cleaning the substrate by ejecting a cleaning fluid onto the substrate held by the polishing head located at the predetermined position, while the shutter is covering the release nozzle; after cleaning of the substrate, moving the shutter to a retreat position away from the release nozzle; and then releasing the substrate from the polishing head by ejecting a releasing shower from the release nozzle into a gap between the polishing head and the substrate.

In an embodiment, there is provided a polishing method comprising: polishing a substrate by pressing the substrate against a polishing pad on a polishing table by a polishing head while moving the polishing table and the polishing head relative to each other; moving the polishing head, holding the substrate, to a predetermined position above a substrate transfer device; moving a release nozzle, which is located at the substrate transfer device, to a retreat position away from the substrate transfer device; cleaning the substrate by ejecting a cleaning fluid onto the substrate held by the polishing head located at the predetermined position, while the release nozzle is located at the retreat position; after cleaning of the substrate, moving the release nozzle from the retreat position to a shower position; and then releasing the substrate from the polishing head by ejecting a releasing shower from the release nozzle into a gap between the polishing head and the substrate.

In an embodiment, the release nozzle is a Laval nozzle, and releasing the substrate comprising releasing the substrate from the polishing head by ejecting a supersonic parallel flow from the Laval nozzle into the gap between the polishing head and the substrate.

According to the above-described embodiments, the fluid ejected from the release nozzle, the fluid ejected toward the release nozzle, the shutter, and the movement of the release nozzle can prevent contaminants, such as abrasive grains and polishing debris, from being attached to the release nozzle. Therefore, the releasing shower ejected from the release nozzle does not cause contamination of a next substrate.

According to the above-described embodiments, the supersonic parallel flow is ejected as a release jet flow from the release nozzle which is constructed as the Laval nozzle. The release jet flow can be properly delivered into the gap between the substrate and a membrane even if the gap is small, because the release jet flow is a parallel flow. As a result, it is not necessary to largely inflate the membrane, and it is therefore possible to prevent rupture of fine interconnects formed on the substrate and breakage of the substrate. Further, particles, which exist around the release jet flow, cannot follow the release jet flow, because the release jet flow has the supersonic velocity. As a result, the release jet flow does not adsorb the particles, and therefore does not contaminate the substrate. Further, since the release jet flow has the supersonic velocity, a dynamic pressure of the release jet flow can be increased. As a result, releasing of the substrate is accelerated, and a throughput of a polishing operation can be increased.

DESCRIPTION OF EMBODIMENTS

Figure 1:
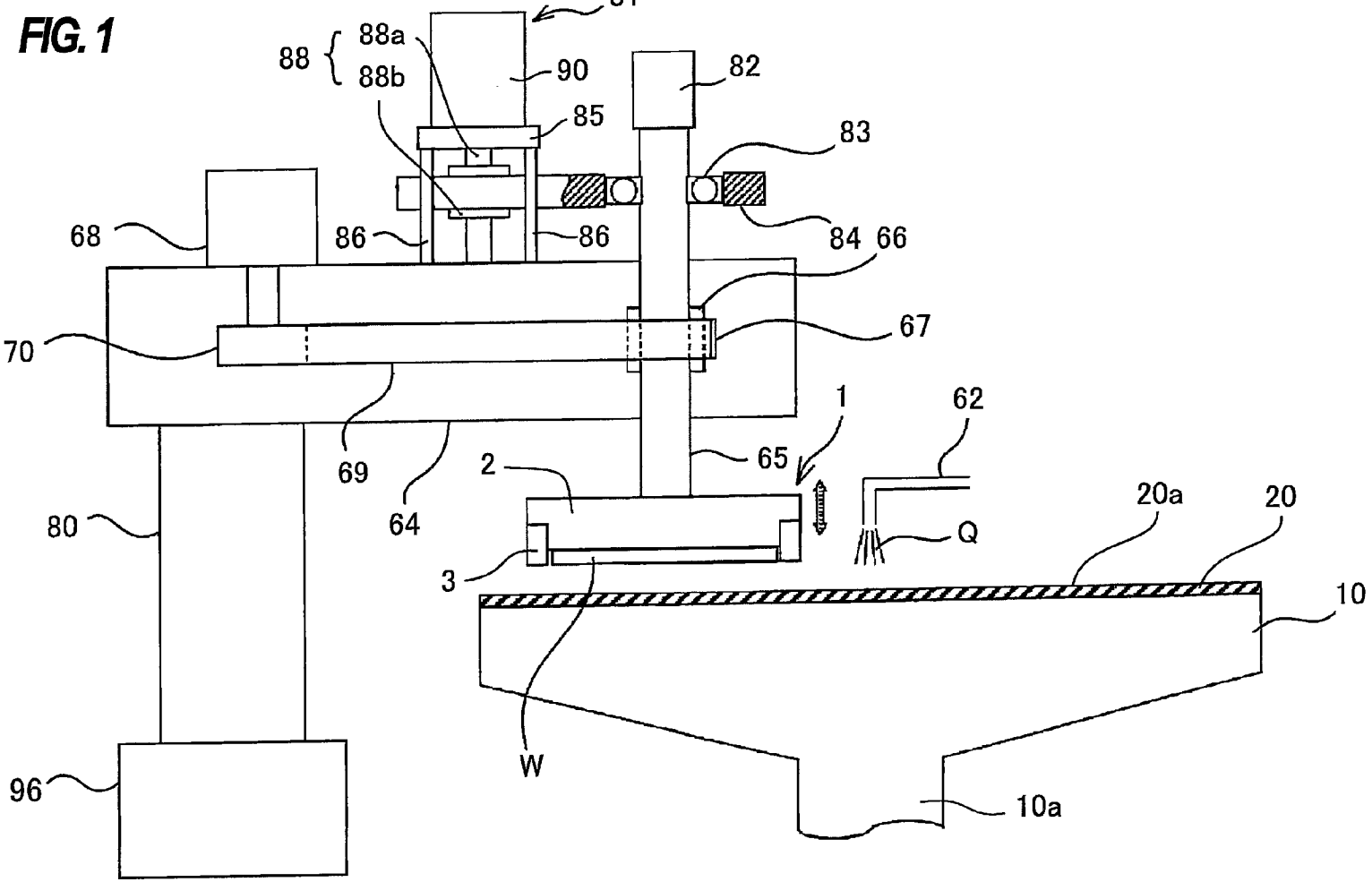
FIG. 1 is a schematic view showing an entire structure of a polishing apparatus according to an embodiment.

Embodiments will be described in detail below with reference to the drawings. Identical or corresponding structural elements are denoted by the same reference numerals in FIGS. 1 through 29 and their repetitive explanations will be omitted.

FIG. 1 is a schematic view showing an entire structure of a polishing apparatus according to an embodiment. As shown in FIG. 1, the polishing apparatus includes a polishing table 10 for supporting a polishing pad 20, and a polishing head (or a substrate holder) 1 for holding a wafer W, which is an example of a substrate, and pressing the wafer W against the polishing pad 20 on the polishing table 10.

The polishing table 10 is coupled via a table shaft 10*a* to a motor (not shown) disposed below the polishing table 10, so that the polishing table 10 is rotatable about the table shaft 10*a*. The polishing pad 20 is attached to an upper surface of the polishing table 10, and a surface 20*a* of the polishing pad 20 serves as a polishing surface for polishing the wafer W. A polishing-liquid supply nozzle 62 is provided above the polishing table 10 so that a polishing liquid Q is supplied from the polishing-liquid supply nozzle 62 onto the polishing pad 20.

The polishing head 1 is basically constituted by a head body 2 for pressing the wafer W against the polishing surface 20*a*, and a retainer ring 3 for retaining the wafer W so as to prevent the wafer W from being ejected from the polishing head 1.

The polishing head 1 is coupled to a polishing head shaft 65, which can be moved in a vertical direction relative to a polishing head arm 64 by a vertically moving mechanism 81. This vertical movement of the polishing head shaft 65 enables the entirety of the polishing head 1 to move upward and downward and enables positioning of the polishing head 1 with respect to the polishing head arm 64. A rotary joint 82 is mounted to an upper end of the polishing head shaft 65.

The vertically moving mechanism 81 for moving the polishing head shaft 65 and the polishing head 1 in the vertical direction includes a bridge 84 for rotatably supporting the polishing head shaft 65 through a bearing 83, a ball screw 88 mounted to the bridge 84, a support pedestal 85 supported by support posts 86, and a servomotor 90 mounted on the support pedestal 85. The support pedestal 85, which supports the servomotor 90, is fixedly mounted to the polishing head arm 64 through the support posts 86.

The ball screw 88 includes a screw shaft 88*a* coupled to the servomotor 90 and a nut 88*b* that engages with this screw shaft 88*a*. The polishing head shaft 65 is movable together with the bridge 84 in the vertical direction. Therefore, when the servomotor 90 is set in motion, the bridge 84 moves through the ball screw 88 in the vertical direction, so that the polishing head shaft 65 and the polishing head 1 move in the vertical direction.

Further, the polishing head shaft 65 is coupled to a rotary sleeve 66 by a key (not shown). A timing pulley 67 is secured to a circumferential surface of this rotary sleeve 66. A polishing-head rotating motor 68 is fixed to the polishing head arm 64, and the timing pulley 67 is coupled to a timing pulley 70, mounted to the polishing-head rotating motor 68, through a timing belt 69. Therefore, when the polishing-head rotating motor 68 is set in motion, the rotary sleeve 66 and the polishing head shaft 65 are rotated in unison with each other through the timing pulley 70, the timing belt 69, and the timing pulley 67, thus rotating the polishing head 1. The polishing head arm 64 is supported by an arm shaft 80, which is rotatably supported by a frame (not shown). The polishing apparatus further includes a controller (not shown) for controlling devices including the polishing-head rotating motor 68 and the servomotor 90.

The polishing head 1 is configured to be able to hold the wafer W on its lower surface via vacuum suction. An arm shaft 80 is coupled to an arm motor 96, and the polishing head arm 64 is configured to be able to pivot on the arm shaft 80 by this arm motor 96. Thus, the polishing head 1, which holds the wafer W on its lower surface, is moved between a position above a substrate transfer device (which will be discussed later) and a position above the polishing table 10 by a pivotal movement of the polishing head arm 64. In this embodiment, a polishing-head moving mechanism for moving the polishing head 1 is constructed by the arm shaft 80, the arm motor 96, and the polishing head arm 64.

Polishing of the wafer W is performed as follows. the polishing head 1 and the polishing table 10 are rotated individually, while the polishing liquid Q is supplied onto the polishing pad 20 from the polishing-liquid supply nozzle 62 provided above the polishing table 10. In this state, the polishing head 1 presses the wafer W against the polishing surface 20*a* of the polishing pad 20 so that the wafer W is placed in sliding contact with the polishing surface 20*a* of the polishing pad 20. A surface of the wafer W is polished by the polishing pad 20 in the presence of the polishing liquid Q.

Figure 2:
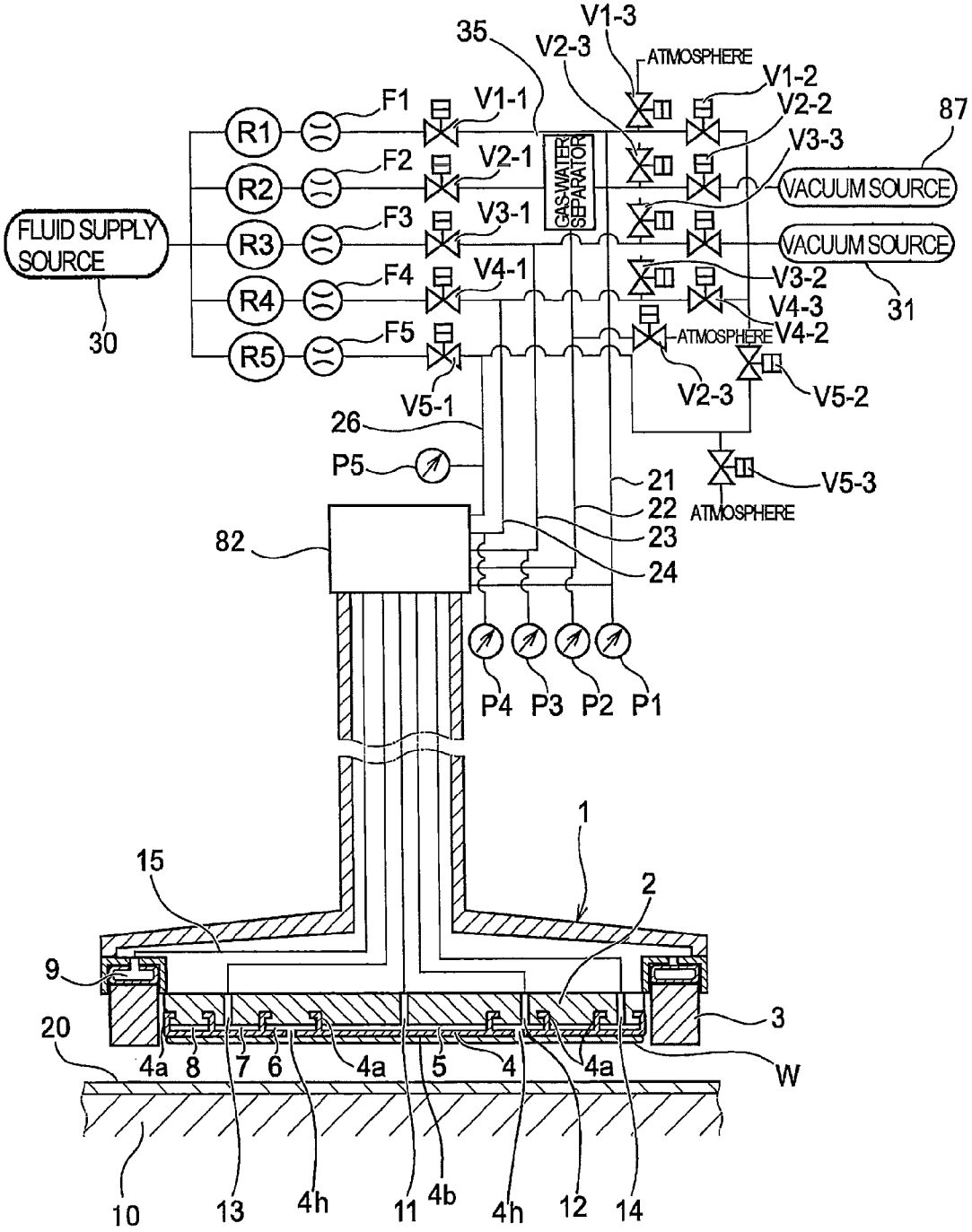
FIG. 2 is a schematic cross-sectional view of a polishing head for holding a wafer and pressing the wafer against a polishing pad on a polishing table.

Next, the polishing head 1 will be described. FIG. 2 is a schematic cross-sectional view showing the polishing head 1 for holding the wafer W, which is an object to be polished, and pressing the wafer W against the polishing pad 20 on the polishing table 10.

As shown in FIG. 2, the polishing head 1 includes a membrane (or flexible membrane) 4 for pressing the wafer W against the polishing pad 20, the head body 2 (which is also referred to as a carrier) holding the membrane 4, and the retainer ring 3 for directly pressing the polishing pad 20. The head body 2 is in approximate a disk shape. The retainer ring 3 is attached to a peripheral portion of the head body 2. The head body 2 is formed of resin, such as engineering plastic (e.g., PEEK). The membrane 4, which is brought into contact with a rear surface of the wafer W, is attached to a lower surface of the head body 2. The membrane 4 is formed of a highly strong and durable rubber material, such as ethylene propylene rubber (EPDM), polyurethane rubber, silicone rubber, or the like.

The membrane 4 has a plurality of concentric partition walls 4*a* defining multiple pressure chambers, which are a circular central chamber 5, an annular ripple chamber 6, an annular outer chamber 7, and an annular edge chamber 8. These pressure chambers are located between an upper surface of the membrane 4 and a lower surface of the head body 2. The central chamber 5 is formed at the central portion of the head body 2, and the ripple chamber 6, the outer chamber 7, and the edge chamber 8 are concentrically arranged in the order from the central portion to the peripheral portion of the head body 2.

The wafer W is held on a wafer holding surface (a substrate holding surface) 4*b* which is formed by the membrane 4. The membrane 4 has a plurality of holes 4*h* for wafer suction located in positions corresponding to the position of the ripple chamber 6. While the holes 4*h* are located in the corresponding position of the ripple chamber 6 in this embodiment, the holes 4*h* may be located in positions of other pressure chamber. A passage 11 communicating with the central chamber 5, a passage 12 communicating with the ripple chamber 6, a passage 13 communicating with the outer chamber 7, and a passage 14 communicating with the edge chamber 8 are formed in the head body 2. The passages 11, 13, and 14 are coupled via the rotary joint 82 to passages 21, 23, and 24, respectively. These passages 21, 23, and 24 are coupled to a fluid supplying source 30 via respective valves V1-1, V3-1, and V4-1 and respective pressure regulators R1, R3, and R4. The passages 21, 23, and 24 are coupled to a vacuum source 31 through valves V1-2, V3-2, and V4-2, respectively, and further communicate with the atmosphere through valves V1-3, V3-3, and V4-3, respectively. The fluid supplying source 30 is, for example, a fluid supplying line provided in a facility in which the polishing apparatus is installed. For example, nitrogen or air having a pressure of about 0.4 Mpa to 0.6 Mpa flows in this fluid supplying line 30.

The passage 12 communicating with the ripple chamber 6 is coupled to a passage 22 via the rotary joint 82. The passage 22 is coupled to the fluid supplying source 30 via a gas-water separation tank 35, a valve V2-1, and a pressure regulator R2. Further, the passage 22 is coupled to a vacuum source 87 via the gas-water separation tank 35 and a valve V2-2, and further communicates with the atmosphere via a valve V2-3.

A retainer-ring pressure chamber 9, which is in an annular shape and is formed of a flexible membrane, is provided right above the retainer ring 3. This retainer-ring pressure chamber 9 is coupled to a passage 26 via a passage 15 formed in the head body 2 and the rotary joint 82. The passage 26 is coupled to the fluid supplying source 30 via a valve V5-1 and a pressure regulator R5. Further, the passage 26 is coupled to the vacuum source 31 via a valve V5-2, and communicates with the atmosphere via a valve V5-3.

Each of the pressure regulators R1, R2, R3, R4, and R5 has a pressure regulating function to regulate pressures of the fluid (e.g., a gas, such as air or nitrogen) supplied from the fluid supplying source 30 to the central chamber 5, the ripple chamber 6, the outer chamber 7, the edge chamber 8, and the retainer-ring pressure chamber 9, respectively. The pressure regulators R1, R2, R3, R4, and R5 and the valves V1-1 to V1-3, V2-1 to V2-3, V3-1 to V3-3, V4-1 to V4-3, and V5-1 to V5-3 are coupled to the controller which is not illustrated, so that operations of these pressure regulators and these valves are controlled by the controller.

Pressure sensors P1, P2, P3, P4, and P5 and flow-rate sensors F1, F2, F3, F4, and F5 are provided in the passages 21, 22, 23, 24, and 26, respectively. The pressures in the central chamber 5, the ripple chamber 6, the outer chamber 7, the edge chamber 8, and the retainer-ring pressure chamber 9 are measured by the presser sensors P1, P2, P3, P4, and P5, respectively. Flow rates of the pressurized fluid supplied to the central chamber 5, the ripple chamber 6, the outer chamber 7, the edge chamber 8, and the retainer-ring pressure chamber 9 are measured by the flow-rate sensors F1, F2, F3, F4, and F5, respectively.

The pressures of the fluid supplied to the central chamber 5, the ripple chamber 6, the outer chamber 7, the edge chamber 8, and the retainer-ring pressure chamber 9 can be independently controlled by the pressure regulators R1, R2, R3, R4, and R5. With this structure, forces of pressing the wafer W against the polishing pad 20 can be adjusted at respective local areas of the wafer, while a force of pressing the polishing pad 20 by the retainer ring 3 can be adjusted.

Next, a sequence of polishing operations of the polishing apparatus constructed as shown in FIG. 1 and FIG. 2 will be described. The polishing head 1 receives the wafer W from a pusher (which will be described later) and holds the wafer W thereon by the vacuum suction. Holding of the wafer W via the vacuum suction is achieved by producing a vacuum in the plurality of holes 4*h* by the vacuum source 87.

The polishing head 1, holding the wafer W, is lowered to a preset polishing position. At this polishing position, the retainer ring 3 is brought into contact with the polishing surface 20*a* of the polishing pad 20, while a small gap (e.g., about 1 mm) is formed between a lower surface (a surface to be polished) of the wafer W and the polishing surface 20*a* of the polishing pad 20, because the wafer W is held on the polishing head 1 before the wafer W is polished. At this time, both the polishing table 10 and the polishing head 1 are being rotated. In this state, the pressurized fluid is supplied into the central chamber 5, the ripple chamber 6, the outer chamber 7, and the edge chamber 8, which are provided behind the wafer W, to inflate the membrane 4, thereby bringing the lower surface of the wafer W into contact with the polishing surface 20*a* of the polishing pad 20. The polishing pad 20 and the wafer W are moved relative to each other, so that the surface of the wafer W is polished.

After polishing of the wafer W is terminated, the wafer W is held by the polishing head 1 again. The polishing head 1, holding the wafer W, is elevated by the vertically moving mechanism 81, and is further moved to a predetermined position above the pusher by the pivotal movement of the polishing head arm 64. At this predetermined position, the wafer W is released from the polishing head 1 and transferred to the pusher.

Figure 3:
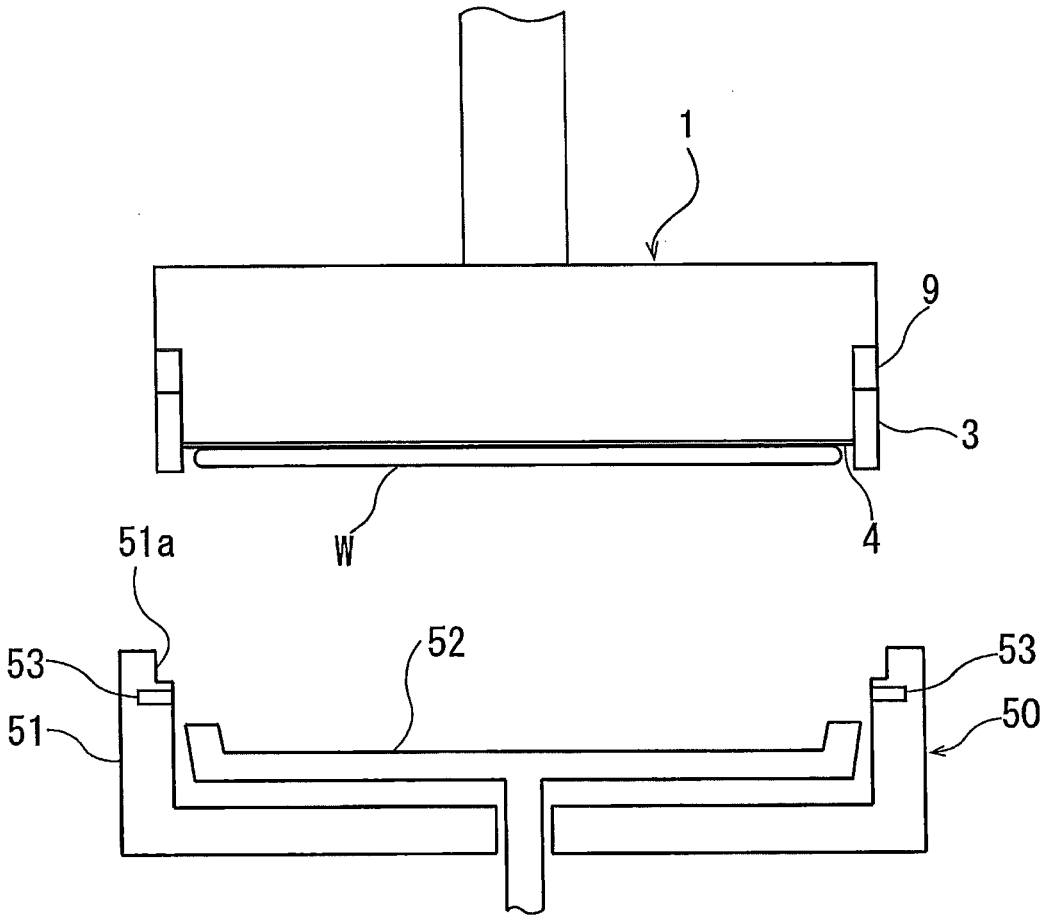
FIG. 3 is a schematic view showing a state in which the polishing head has just been moved to a predetermined position above a pusher in order to transfer the wafer to the pusher.
Figure 4:
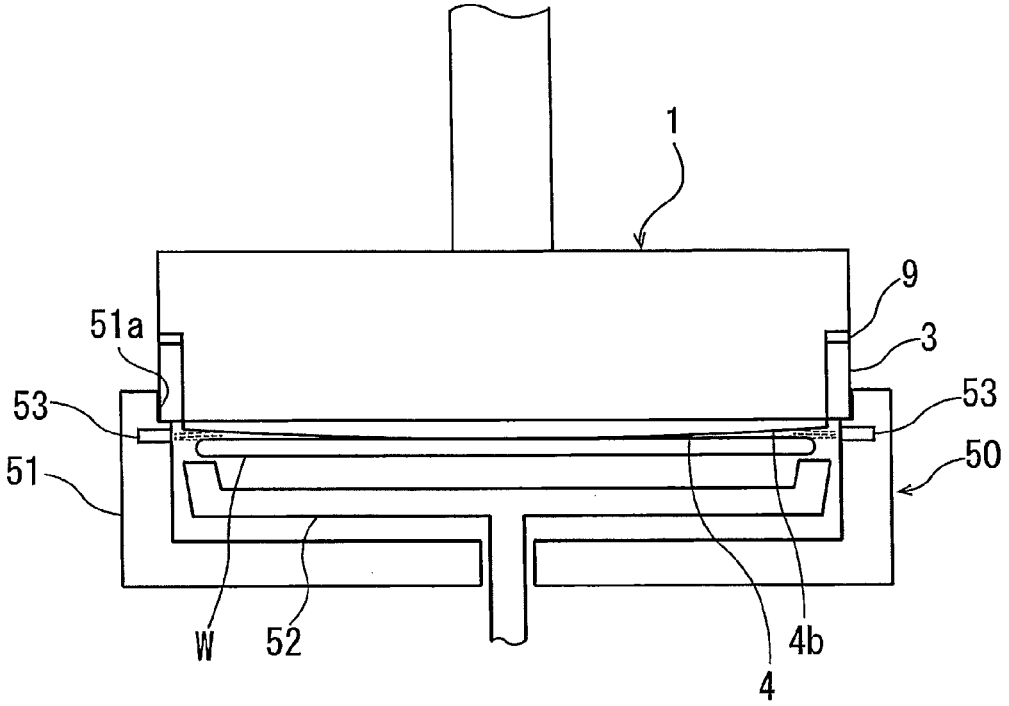
FIG. 4 is a schematic view showing a state in which the pusher is elevated in order for the polishing head to transfer the wafer to the pusher.

FIG. 3 is a schematic view showing a state in which the polishing head 1 has just been moved to the predetermined position above the pusher 50 in order to transfer the wafer W to the pusher 50. FIG. 4 is a schematic view showing a state in which the pusher 50 is elevated in order for the polishing head 1 to transfer the wafer W to the pusher 50. The pusher 50 is a wafer transfer device (or a substrate transfer device) configured to transfer the wafer W, to be polished, to the polishing head 1, and receive the polished wafer W from the polishing head 1. This pusher 50 is located beside the polishing table 10. The wafer W is moved to the predetermined position above the pusher 50 while the polishing head 1 keeps holding the wafer thereon.

As shown in FIG. 3 and FIG. 4, the pusher 50 includes a polishing-head guide 51 having an annular step 51*a* into which an outer peripheral surface of the retainer ring 3 can be fitted for achieving positioning the polishing head 1, a pusher stage 52 for supporting the wafer W when the wafer W is transferred between the polishing head 1 and the pusher 50, an air cylinder (not shown) for moving the pusher stage 52 in the vertical direction, and an air cylinder (not shown) for moving the pusher stage 52 and the polishing-head guide 51 in the vertical direction.

The pusher 50 is provided with release nozzles 53, which are formed in the polishing-head guide 51, for ejecting a fluid (or a releasing shower). The release nozzles 53 are arranged at predetermined intervals along a circumferential direction of the polishing-head guide 51. Each release nozzle 53 is configured to eject the releasing shower, which is constituted by a mixture of pressurized nitrogen and pure water, in a radially inward direction of the polishing-head guide 51.

Next, a wafer releasing operation (or a substrate releasing operation) for transferring the wafer W from the polishing head 1 to the pusher 50 will be described. After the polishing head 1 is moved to the predetermined position above the pusher 50, the pusher 50 is elevated as shown in FIG. 4 until the outer peripheral surface of the retainer ring 3 is fitted into the annular step 51*a* of the polishing-head guide 51, so that the polishing head 1 is aligned with the pusher 50. At this time, the polishing-head guide 51 pushes the retainer ring 3 upwardly, and at the same time, the vacuum is produced in the retainer-ring pressure chamber 9, thereby elevating the retainer ring 3 rapidly.

When elevating of the pusher 50 is completed, the wafer W and the membrane 4 are exposed, because a bottom surface of the retainer ring 3 is pushed upwardly to a position higher than a lower surface of the membrane 4. Thereafter, vacuum-chucking of the wafer W by the polishing head 1 is stopped, and a wafer release operation is performed. Instead of elevating the pusher 50, the polishing head 1 may be lowered to come into contact with the pusher 50.

When the wafer release operation is performed, the pressure chamber (e.g., the ripple chamber 6) of the membrane 4 is pressurized at a low pressure (e.g., at most 0.1 MPa) to inflate the membrane 4. As a result, a gap is formed between the peripheral edge of the wafer W and the membrane 4. The releasing shower, comprising the fluid mixture of pressurized nitrogen and pure water, is then ejected into this gap from the release nozzles 53, thereby releasing the wafer W from the membrane 4. The wafer W is received by the pusher stage 52, and is then transferred from the pusher stage 52 to the transporter, such as a transfer robot. While the fluid mixture of the pressurized nitrogen and the pure water is used as the releasing shower in this embodiment, the releasing shower may be constituted by only a pressurized gas or only a pressurized liquid, or may be constituted by a pressurized fluid of other combination.

In the polishing apparatus according to this embodiment, the following four operations, including the above-described wafer releasing operation, are performed after the polishing operation on the polishing pad 20 is terminated. These four operations will be described with reference to FIGS. 5 through 8.

Figure 5:
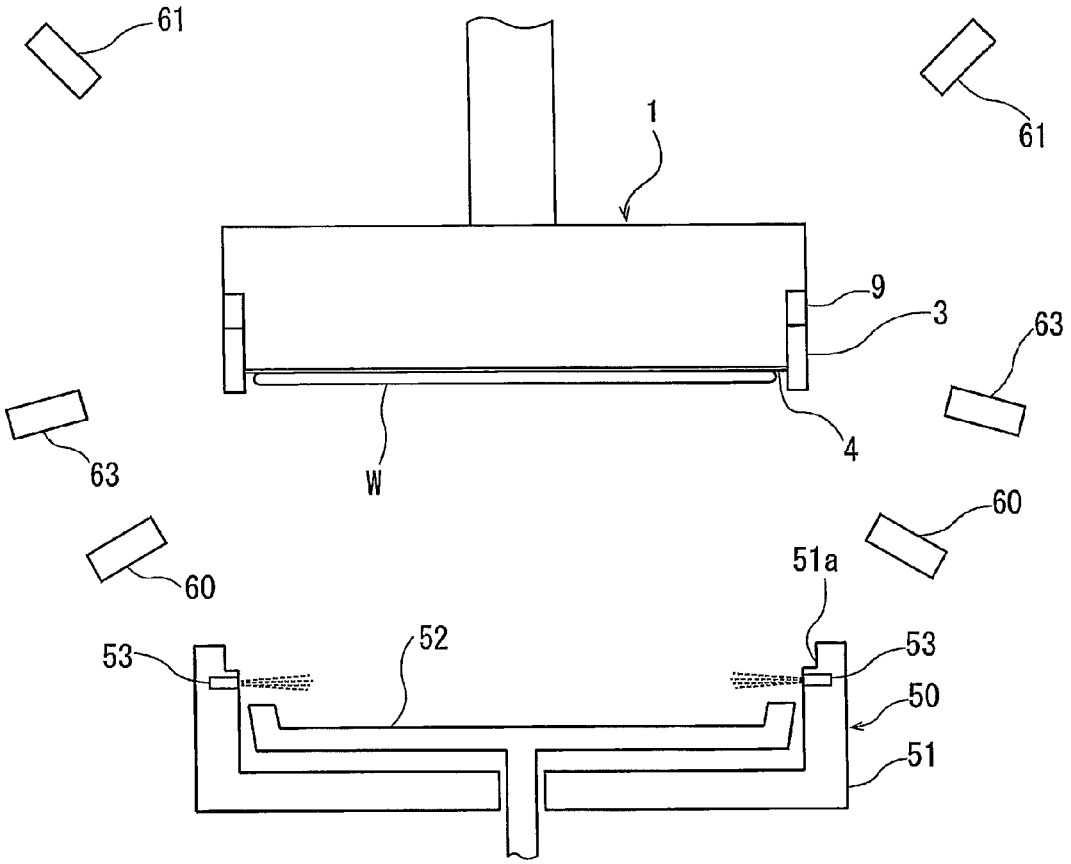
FIG. 5 is a schematic view showing a polishing-head moving operation in which the polishing head, holding a polished wafer, is moved to a predetermined position above the pusher.
Figure 6:
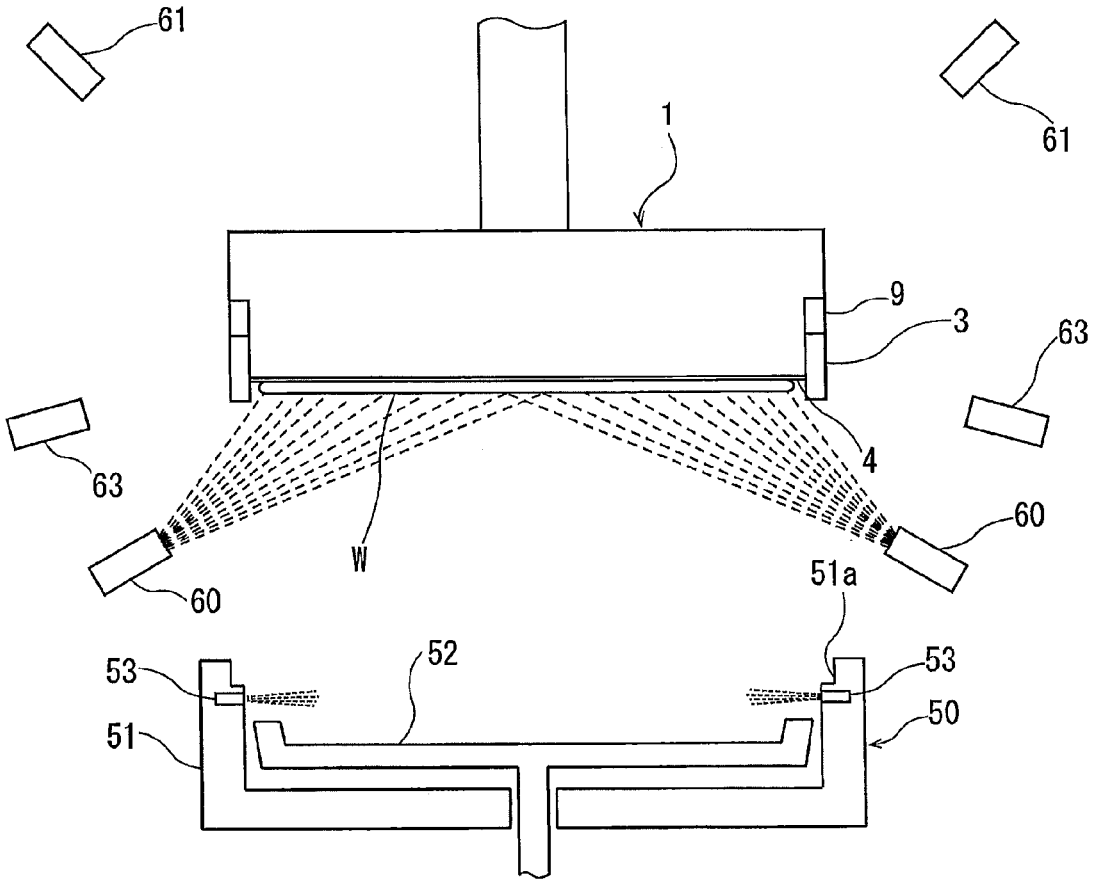
FIG. 6 is a schematic view showing a wafer cleaning operation in which a polished surface of the wafer held by the polishing head is cleaned.
Figure 7:
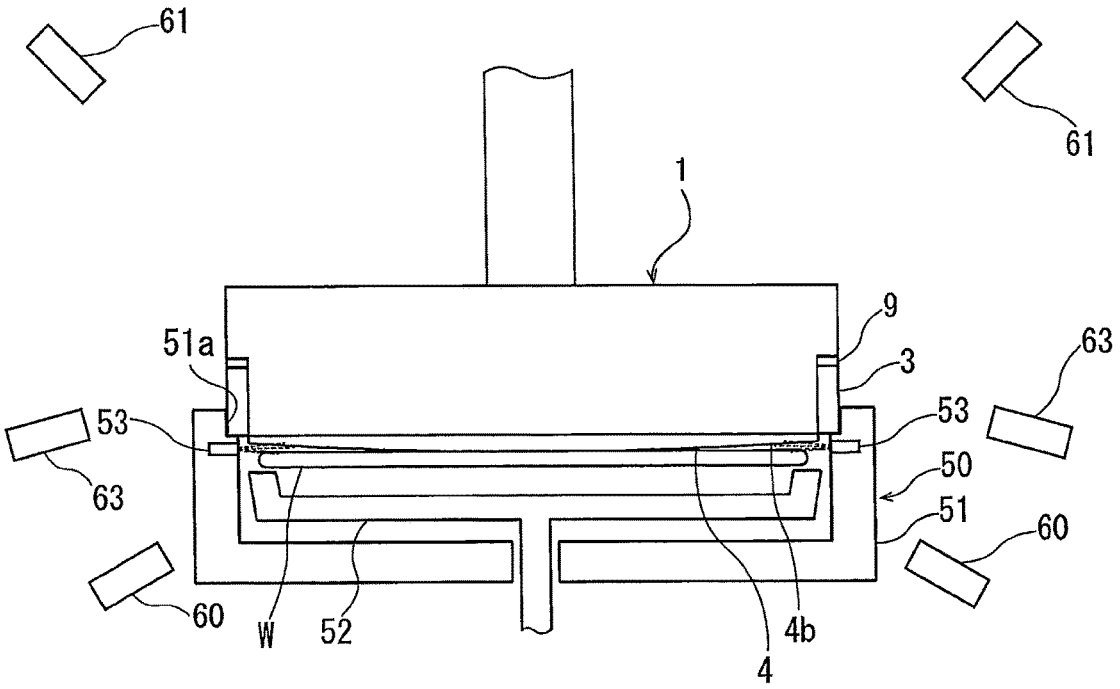
FIG. 7 is a schematic view showing a wafer releasing operation in which the wafer is transferred from the polishing head to the pusher.
Figure 8:
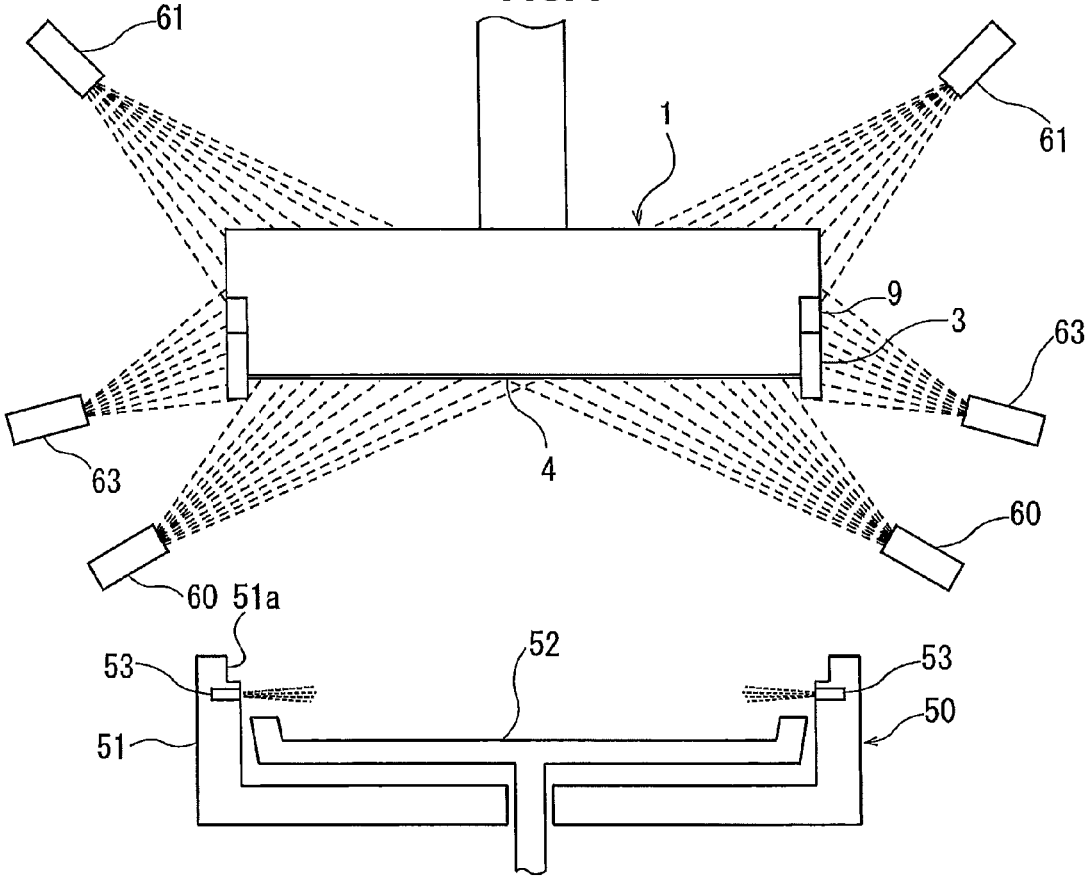
FIG. 8 is a schematic view showing a polishing-head cleaning operation in which the polishing head is cleaned after the polishing head has transferred the wafer to the pusher.

FIG. 5 is a schematic view showing a polishing-head moving operation in which the polishing head 1, holding the polished wafer W, is moved to the predetermined position above the pusher 50. In FIG. 5, the polishing head 1 that has been moved to the predetermined position is illustrated. FIG. 6 is a schematic view showing a wafer cleaning operation (or a substrate cleaning operation) for cleaning the polished surface of the wafer W held by the polishing head 1. FIG. 7 is a schematic view showing a wafer releasing operation (or a substrate releasing operation) for transferring the wafer W, held by the polishing head 1, to the pusher 50. FIG. 8 is a schematic view showing a polishing-head cleaning operation for cleaning the polishing head 1 after transferring the wafer W to the pusher 50.

As shown in FIG. 5, the polishing head 1, holding the polished wafer W, is moved to the predetermined position above the pusher 50, and subsequently the wafer cleaning operation is performed. As shown in FIG. 6, the polishing apparatus has a plurality of (two in the illustrated example) wafer-cleaning nozzles (or substrate-cleaning nozzles) 60 configured to eject a fluid toward the polished surface of the wafer W held by the polishing head 1 that is located at the predetermined position above the pusher 50. The wafer-cleaning nozzles 60 are disposed below the polishing head 1. The wafer-cleaning nozzles 60 are oriented obliquely upward so as to deliver a jet of the fluid to the polished surface of the wafer W obliquely from below the polishing head 1. The fluid ejected from the wafer-cleaning nozzle 60 is, for example, pure water.

The wafer cleaning operation shown in FIG. 6 is performed after the polishing-head moving operation shown in FIG. 5 is performed. In the wafer cleaning operation, the fluid is ejected from the wafer-cleaning nozzles 60 to clean the polished surface of the wafer W. As a result, abrasive grains, polishing debris, and other substances, which are attached to the polished surface of the wafer W, are washed away.

After the wafer cleaning operation shown in FIG. 6, the wafer releasing operation shown in FIG. 7 is performed. In this wafer releasing operation, the membrane 4 is inflated to form the gap between the peripheral edge of the wafer W and the membrane 4, as described above. The releasing shower is ejected into this gap from the release nozzles 53, thereby releasing the wafer W from the polishing head 1. The wafer W that has been transferred from the polishing head 1 to the pusher 50 is then transferred to the transporter, such as a transfer robot, and is transported to a next process, such as cleaning of the wafer.

After the wafer W is transported to the next process, the polishing-head cleaning operation shown in FIG. 8 is performed. As shown in FIG. 8, the polishing apparatus has a plurality of polishing-head cleaning nozzles 61, 63 configured to clean the entirety of the polishing head 1 including the membrane 4. These polishing-head cleaning nozzles 61, 63 are disposed above the pusher 50 and the wafer-cleaning nozzles 60.

The polishing-head cleaning nozzles 61, 63 are, for example, constructed by four upper polishing-head cleaning nozzles 61 disposed above the polishing head 1 and four lower polishing-head cleaning nozzles 63 disposed beside the polishing head 1. The upper polishing-head cleaning nozzles 61 are oriented obliquely downward so as to eject a cleaning fluid onto the polishing head 1 obliquely from above of the polishing head 1. The upper polishing-head cleaning nozzles 61 are arranged at equal intervals along a circumferential direction of the polishing head 1. The lower polishing-head cleaning nozzles 63 are oriented obliquely upward so as to eject a cleaning fluid onto the polishing head 1 obliquely from below the polishing head 1. The lower polishing-head cleaning nozzles 63 are arranged at equal intervals along the circumferential direction of the polishing head 1. The cleaning fluid ejected from the polishing-head cleaning nozzles 61, 63 is, for example, pure water.

In the polishing-head cleaning operation, the cleaning fluid is ejected not only from the polishing-head cleaning nozzles 61, 63, but also from the wafer-cleaning nozzles 60. The cleaning fluid that is ejected from the wafer-cleaning nozzles 60 after the wafer is released from the polishing head 1 can clean the wafer holding surface 4*b* of the membrane 4. The cleaning fluid ejected from the wafer-cleaning nozzles 60 and the polishing-head cleaning nozzles 61, 63 can wash away the abrasive grains and the polishing debris from the polishing head 1.

When the fluid is ejected from the wafer-cleaning nozzles 60 and the polishing-head cleaning nozzles 61, 63, the pusher 50 is present below the polishing head 1. As a result, the fluid that has toughed the wafer W and the polishing head 1 falls onto the pusher 50. The fluid used in the above-described cleaning processes contains contaminants, such as the abrasive grains and the polishing debris attached to the wafer W and the polishing head 1. These contaminants cause the contamination of the release nozzles 53 arranged in the pusher 50. In particular, the fluid containing the abrasive grains and the polishing debris may be sucked into the release nozzles 53 through openings of the release nozzles 53 due to a capillary action. In that case, when a next wafer is released, the abrasive grains and the polishing debris attached to the release nozzles 53 are ejected toward the next wafer together with the releasing shower, thus causing the contamination of the next wafer.

In order to prevent such wafer contamination, in this embodiment, a fluid is discharged from the release nozzles 53 as shown in FIG. 6, while the cleaning fluid is ejected from the wafer-cleaning nozzles 60 in the wafer cleaning operation. Further, the fluid is discharged from the release nozzles 53 as shown in FIG. 8, while the cleaning fluid is ejected from the polishing-head cleaning nozzles 61, 63 and the wafer-cleaning nozzles 60 in the polishing-head cleaning operation. This fluid discharged from the release nozzles 53 is, for example, pure water, and will be hereinafter referred to as an interior self-cleaning fluid. A fluid mixture of nitrogen and pure water may be used as the interior self-cleaning fluid. Alternatively, nitrogen may be used as the interior self-cleaning fluid. Instead of nitrogen, compressed air may be used.

Since the interior self-cleaning fluid is discharged from the release nozzles 53 in the wafer cleaning operation and the polishing-head cleaning operation, the contaminants, such as the abrasive grains and the polishing debris, cannot intrude into the release nozzle 53 even if the cleaning fluid containing the contaminants is brought into contact with the release nozzles 53. As a result, the contamination of the interiors of the release nozzles 53 can be prevented. Further, the contamination of the next wafer, to which a jet of the releasing shower is supplied, can also be prevented.

Immediately after the polishing head 1 is moved from the polishing pad 20 to the predetermined position above the pusher 50, the polishing liquid may drop spontaneously onto the release nozzles 53, thus contaminating the release nozzles 53, even before the cleaning fluid is ejected toward the wafer W. Thus, in this embodiment, in order to prevent such contamination of the release nozzles 53, discharging of the interior self-cleaning fluid from the release nozzles 53 is started before or when the polishing head 1 reaches the predetermined position above the pusher 50, as shown in FIG. 5. Preferably, discharging of the interior self-cleaning fluid from the release nozzles 53 is started immediately before the polishing head 1 reaches the predetermined position above the pusher 50.

According to this embodiment, discharging of the interior self-cleaning fluid from the release nozzles 53 is started before or when the polishing head 1 reaches the predetermined position above the pusher 50, and discharging of the interior self-cleaning fluid is stopped after the wafer cleaning operation is terminated. The interior self-cleaning fluid can prevent the abrasive grains of the polishing liquid and the polishing debris from intruding into the release nozzles 53.

Figure 9:
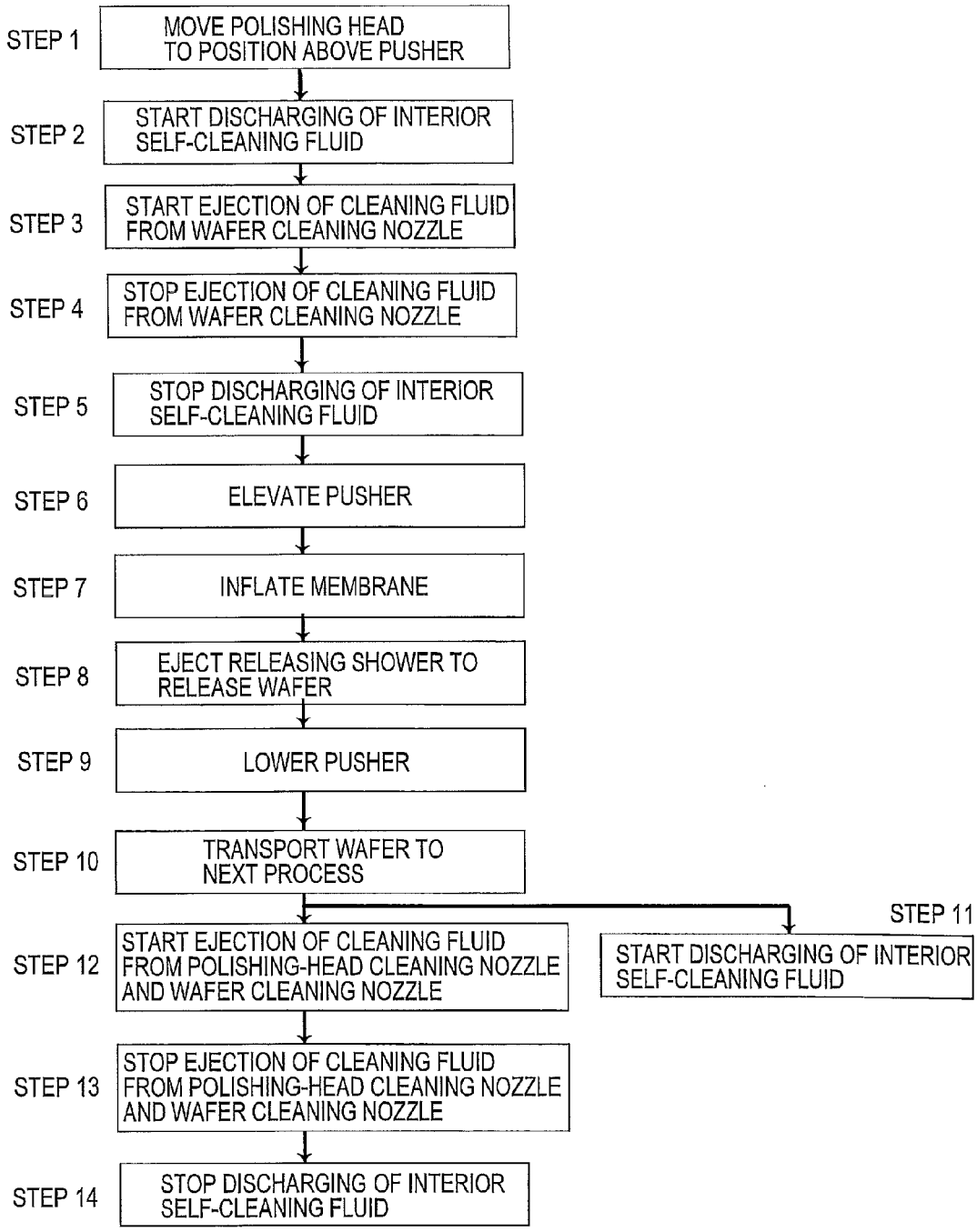
FIG. 9 is a flowchart showing the polishing-head moving operation, the wafer cleaning operation, the wafer releasing operation, and the polishing-head cleaning operation.

FIG. 9 is a flowchart showing the above-described four operations. An operation flow of the polishing apparatus after polishing of the wafer W will be described with reference to FIG. 9. First, the polishing head 1, holding the polished wafer W, is moved to the predetermined position above the pusher 50 (step 1). Before the polishing head 1 reaches the predetermined position or when the polishing head 1 has reached the predetermined position, discharging of the interior self-cleaning fluid from the release nozzles 53 is started (step 2). After the movement of the polishing head 1 is completed, the cleaning fluid is ejected toward the polished surface of the wafer W from the wafer-cleaning nozzles 60 (step 3: the wafer cleaning operation). During this wafer cleaning operation, the interior self-cleaning fluid is continuously discharged from the release nozzles 53. When the ejection of the cleaning fluid from the wafer-cleaning nozzles 60 is stopped (step 4), the wafer cleaning operation is completed.

After the step 4, discharging of the interior self-cleaning fluid from the release nozzles 53 is stopped (step 5). After the step 5, the wafer releasing operation is started. More specifically, the pusher 50 is elevated (step 6) and the pressurized fluid is supplied into the pressure chamber of the membrane 4 to inflate the membrane 4 (step 7), thereby forming the gap between the membrane 4 and the wafer W. The releasing shower is ejected into the gap between the membrane 4 and the wafer W, thereby releasing the wafer W from the polishing head 1 (step 8). The wafer W is received by the pusher 50, and the pusher 50 is then lowered together with the wafer W (step 9). When lowering of the pusher 50 is completed, the wafer releasing operation is completed. Thereafter, the wafer W, held by the lowered pusher 50, is transferred to the transporter, such as a transfer robot, and is then transported to a next process (step 10).

After the step 10, discharging of the interior self-cleaning fluid from the release nozzles 53 is started again (step 11). Simultaneously with or after this, the cleaning fluid is ejected toward the polishing head 1 from the polishing-head cleaning nozzles 61, 63 and the wafer-cleaning nozzles 60 (step 12: the polishing-head cleaning operation). After a predetermined time has elapsed, the ejection of the cleaning fluid from the polishing-head cleaning nozzles 61, 63 and the wafer-cleaning nozzles 60 is stopped (step 13), and the polishing-head cleaning operation is then terminated. Subsequently, discharging of the interior self-cleaning fluid from the release nozzles 53 is stopped (step 14).

Figure 10:
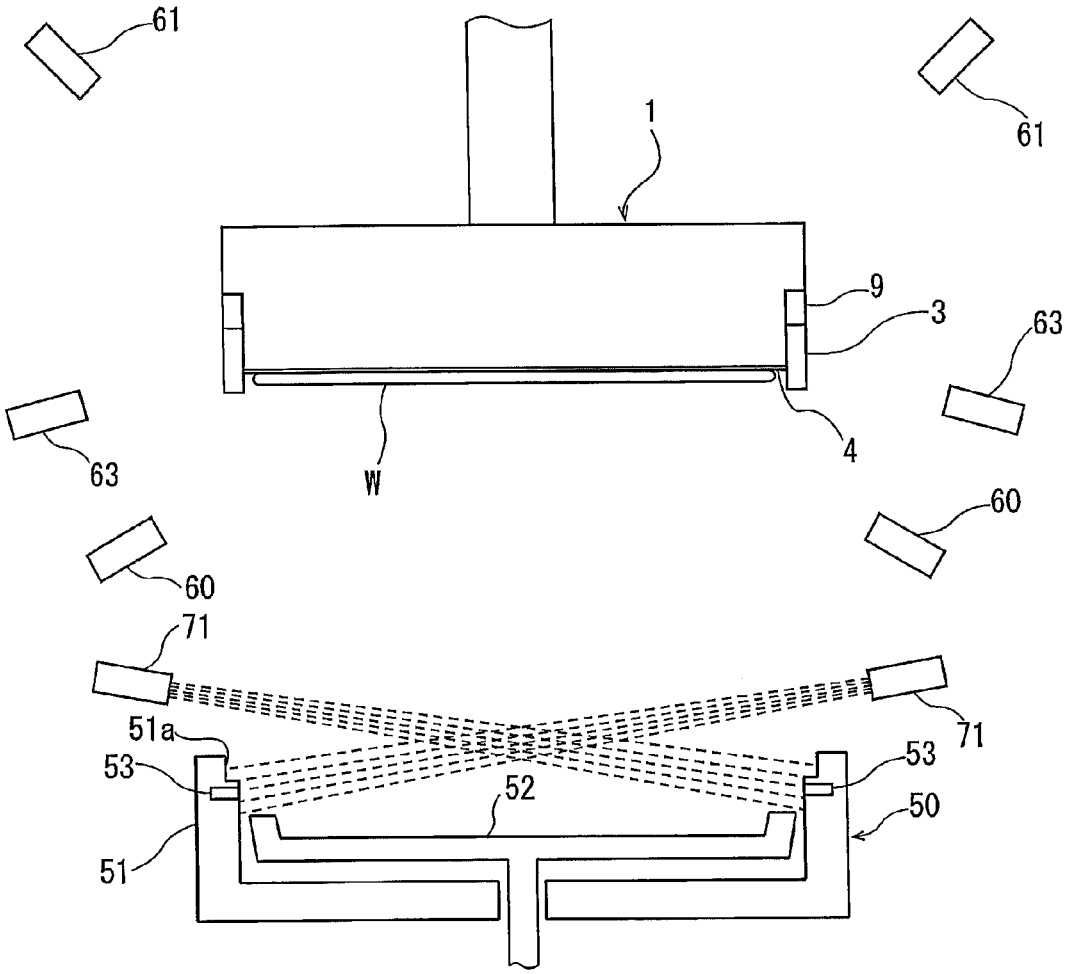
FIG. 10 is a schematic view showing the polishing-head moving operation according another embodiment.
Figure 11:
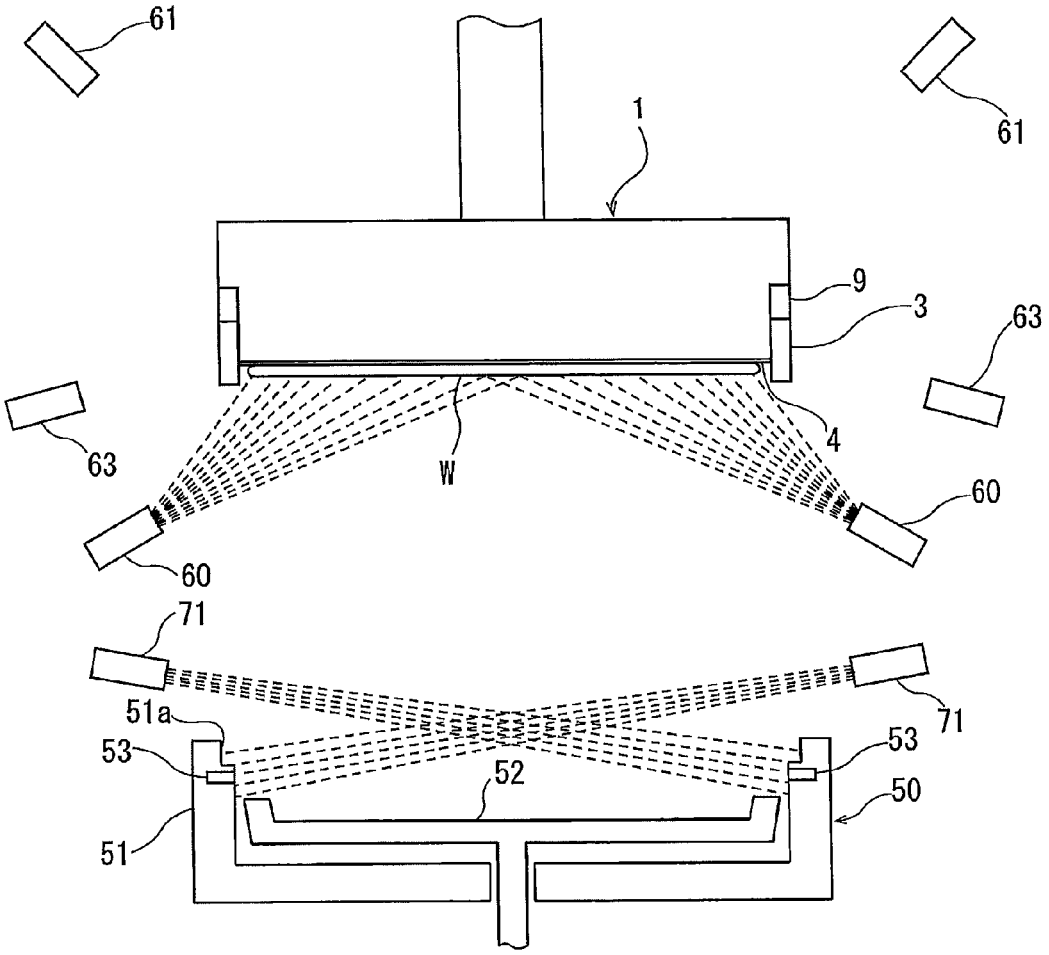
FIG. 11 is a schematic view showing the wafer cleaning operation according to another embodiment.
Figure 12:
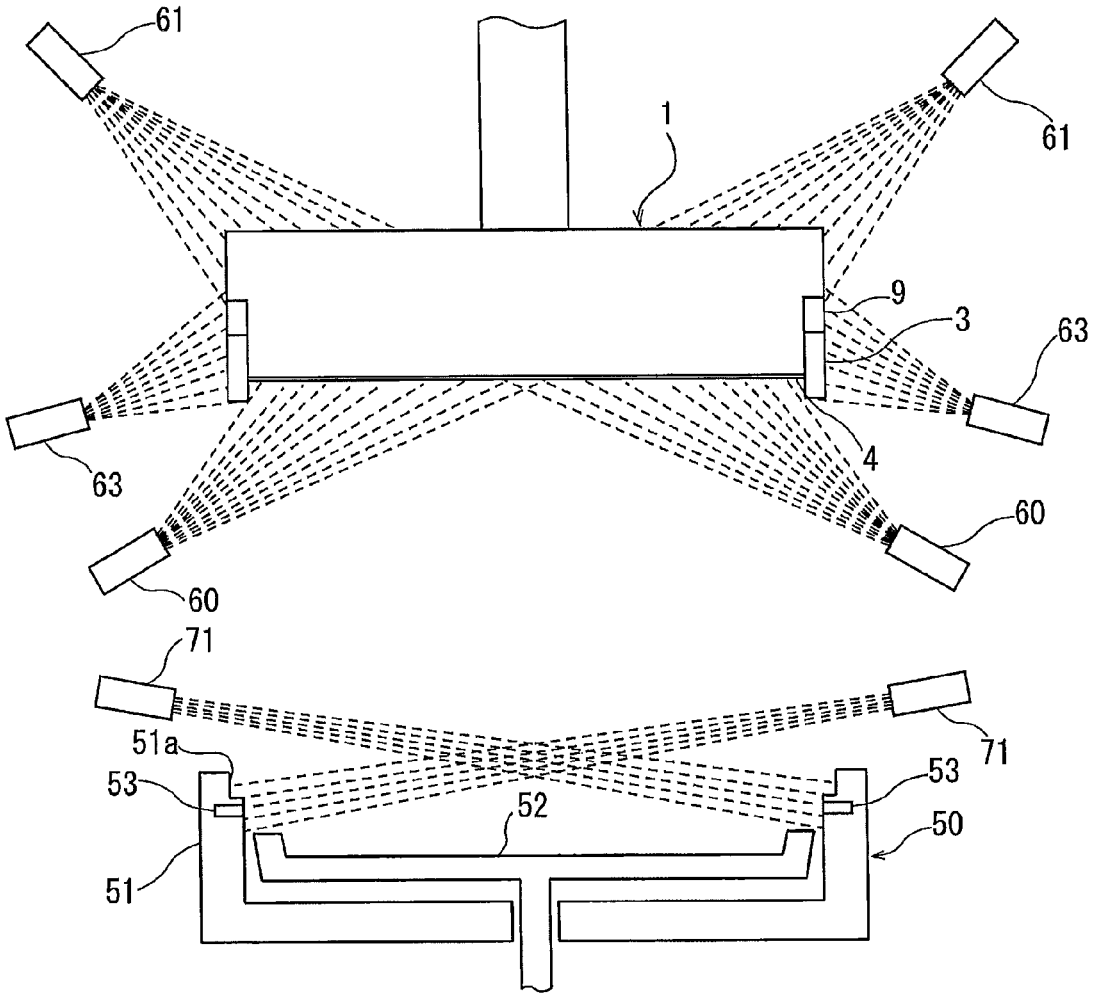
FIG. 12 is a schematic view showing the polishing-head cleaning operation according to another embodiment.

Next, the polishing apparatus according to another embodiment will be described. FIG. 10 is a schematic view showing the polishing-head moving operation according another embodiment, and shows a state in which a movement of the polishing head 1 to the predetermined position above the pusher 50 has been completed. FIG. 11 is a schematic view showing the wafer cleaning operation (substrate cleaning operation) according to another embodiment. FIG. 12 is a schematic view showing the polishing-head cleaning operation according to another embodiment.

As shown in FIGS. 10 through 12, in the polishing apparatus according to this embodiment, release-nozzle cleaning nozzles 71 configured to clean the release nozzles 53 from outside thereof are provided. The release-nozzle cleaning nozzles 71 are oriented toward the release nozzles 53, respectively, and are provided in the same number as that of release nozzles 53. A fluid is ejected toward the release nozzles 53 from the release-nozzle cleaning nozzles 71. This fluid will be hereinafter referred to as an exterior cleaning fluid. The exterior of the release nozzle 53 is cleaned with the exterior cleaning fluid. Pure water is, for example, used as the exterior cleaning fluid. Other structures in this embodiment are the same as those of the embodiment shown in FIGS. 5 through 8, and the corresponding elements are detonated by the same reference numerals, and detailed descriptions thereof are omitted.

Timings of starting and stopping the ejection of the exterior cleaning fluid are the same as timings of starting and stopping discharging of the interior self-cleaning fluid. More specifically, as shown in FIG. 10, the ejection of the exterior cleaning fluid from the release-nozzle cleaning nozzles 71 toward the release nozzles 53 is started before or when the polishing head 1 reaches the predetermined position above the pusher 50 in the polishing-head moving operation. Preferably, the ejection of the exterior cleaning fluid from the release-nozzle cleaning nozzles 71 toward the release nozzles 53 is started immediately before the polishing head 1 reaches the predetermined position above the pusher 50. Further, as shown in FIG. 11 and FIG. 12, during the wafer cleaning operation and the polishing-head cleaning operation, the exterior cleaning fluid is ejected from the release-nozzle cleaning nozzles 71 toward the release nozzles 53.

Although, in this embodiment, the exterior cleaning fluid is used instead of the interior self-cleaning fluid, the interior self-cleaning fluid may also be discharged from the release nozzles 53 in parallel with the ejection of the exterior cleaning fluid in order to reliably prevent the intrusion of the contaminants, such as the abrasive grains and the polishing debris, into the release nozzles 53. A flowchart, which will be described below, in FIG. 13 shows operations according to an embodiment in which the interior self-cleaning fluid is discharged in parallel with the ejection of the exterior cleaning fluid.

Figure 13:
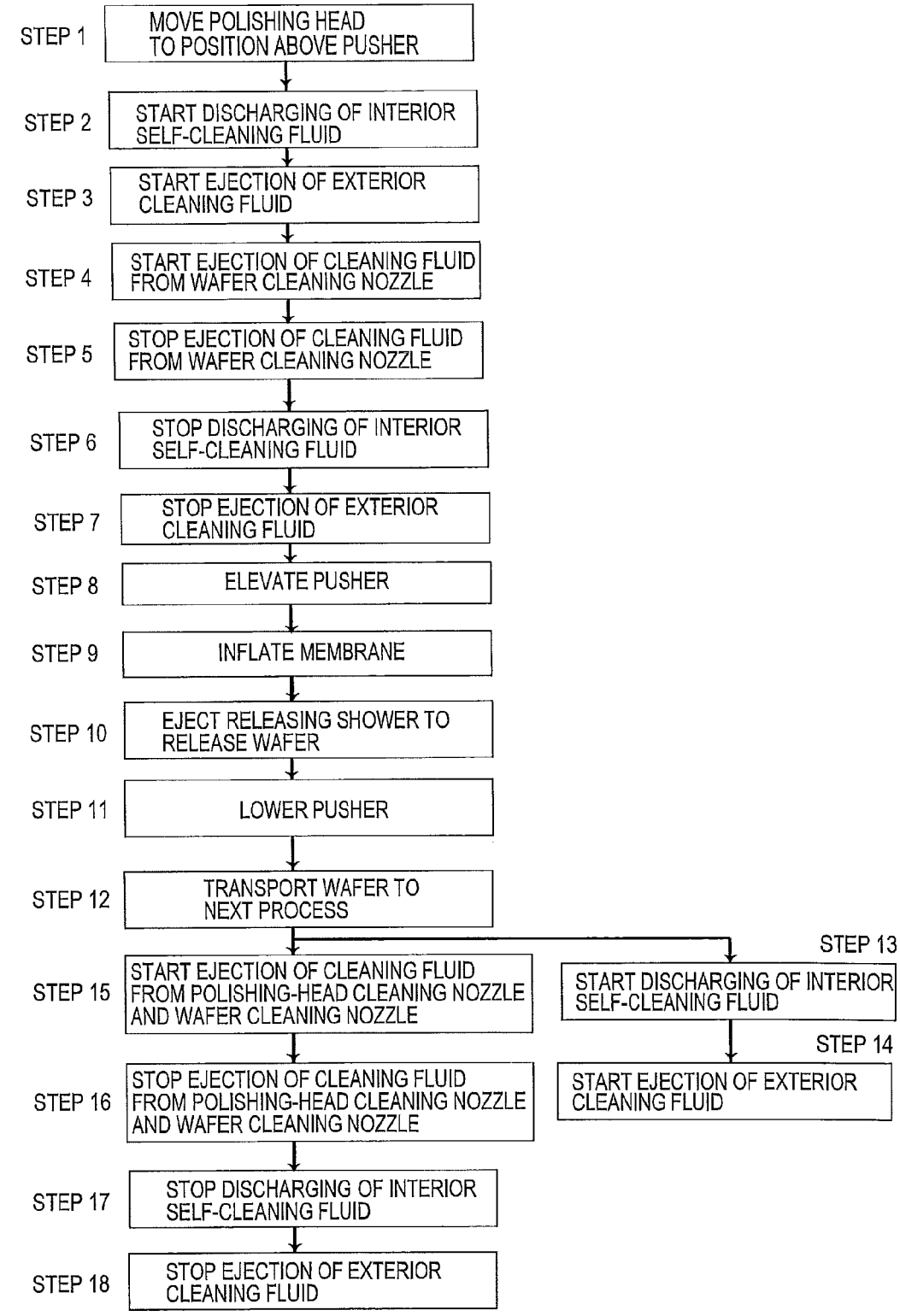
FIG. 13 is a flowchart showing the polishing-head moving operation, the wafer cleaning operation, the wafer releasing operation, and the polishing-head cleaning operation.

As shown in the flowchart in FIG. 13, first, the polishing head 1 holding the polished wafer W is moved to the predetermined position above the pusher 50 (step 1). Before the polishing head 1 reaches the predetermined position or when the polishing head 1 has reached the predetermined position, discharging of the interior self-cleaning fluid from the release nozzles 53 is started (step 2). Further, the ejection of the exterior cleaning fluid from the release-nozzle cleaning nozzles 71 is started (step 3). Then, the wafer cleaning operation is performed by ejecting the cleaning fluid from the wafer-cleaning nozzles 60 (step 4). During the wafer cleaning operation, the interior self-cleaning fluid is continuously discharged and the exterior cleaning fluid is also continuously ejected as well. When the ejection of the cleaning fluid from the wafer-cleaning nozzles 60 is stopped (step 5), the wafer cleaning operation is terminated. Thereafter, discharging of the interior self-cleaning fluid is stopped (step 6), and the ejection of the exterior cleaning fluid is also stopped (step 7).

After the ejection of the exterior cleaning fluid is stopped, the pusher 50 is elevated (step 8). The pressurized fluid is supplied into the pressure chamber of the membrane 4 to inflate the membrane 4 (step 9), thereby forming the gap between the membrane 4 and the wafer W. The releasing shower is ejected into the gap between the membrane 4 and the wafer W, thereby releasing the wafer W from the polishing head 1 (step 10). The wafer W is received by the pusher 50, and the pusher 50 is then lowered together with the wafer W (step 11). When lowering of the pusher 50 is completed, the wafer releasing operation is completed. Thereafter, the wafer W, held by the lowered pusher 50, is transferred to the transporter, such as transfer robot, and is then transported to a next process (step 12).

Subsequently, discharging of the interior self-cleaning fluid is started again (step 13), and the ejection of the exterior cleaning fluid is also started again (step 14). Simultaneously with or after these, the cleaning fluid is ejected toward the polishing head 1 from the polishing-head cleaning nozzles 61, 63 and the wafer-cleaning nozzles 60 so that the polishing-head cleaning operation is started (step 15). After a predetermined time has elapsed, the ejection of the cleaning fluid from the polishing-head cleaning nozzles 61, 63 and the wafer-cleaning nozzles 60 is stopped (step 16). Thereafter, discharging of the interior self-cleaning fluid is stopped (step 17) and the ejection of the exterior cleaning fluid is stopped (step 18).

In this manner, the exterior cleaning fluid is ejected from the release-nozzle cleaning nozzles 71 to clean the release nozzles 53, so that the abrasive grains and the polishing debris, attached to the release nozzles 53, can be washed away. Further, the use of the combination of the interior self-cleaning fluid and the exterior cleaning fluid can further enhance a cleanliness of the release nozzles 53.

Figure 14:
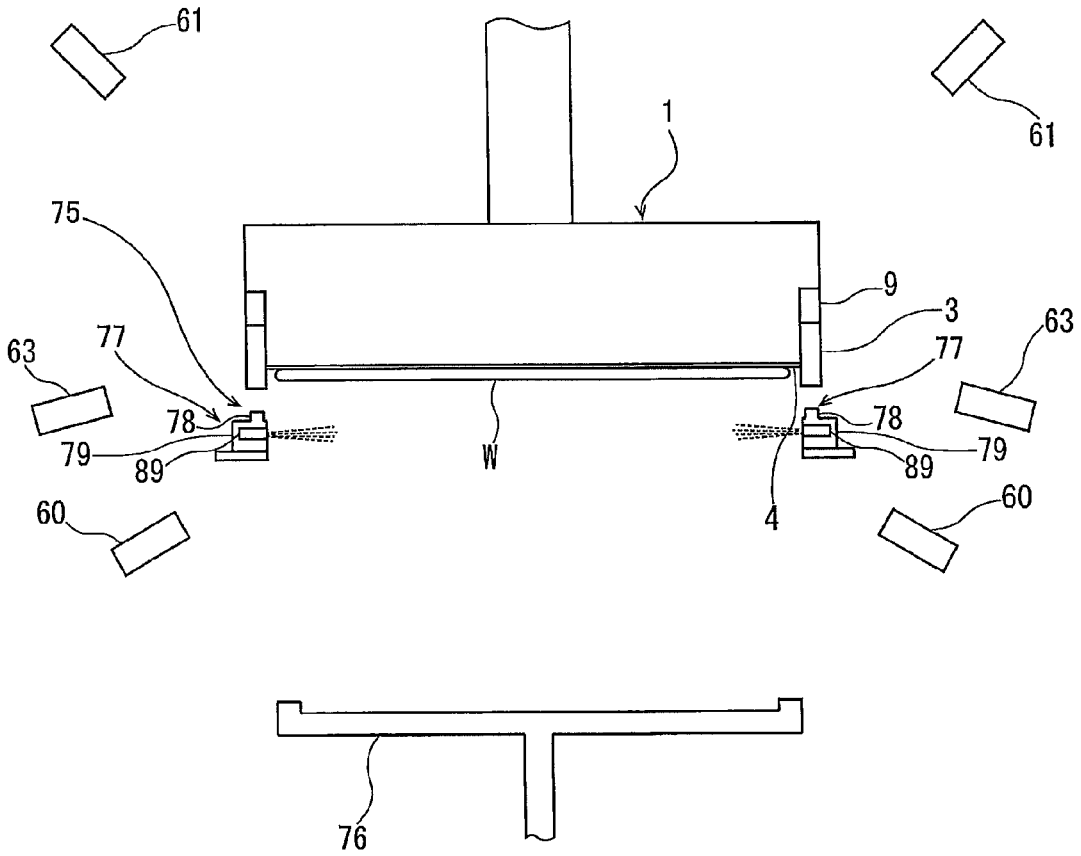
FIG. 14 is a schematic view showing the polishing-head moving operation in still another embodiment.
Figure 15:
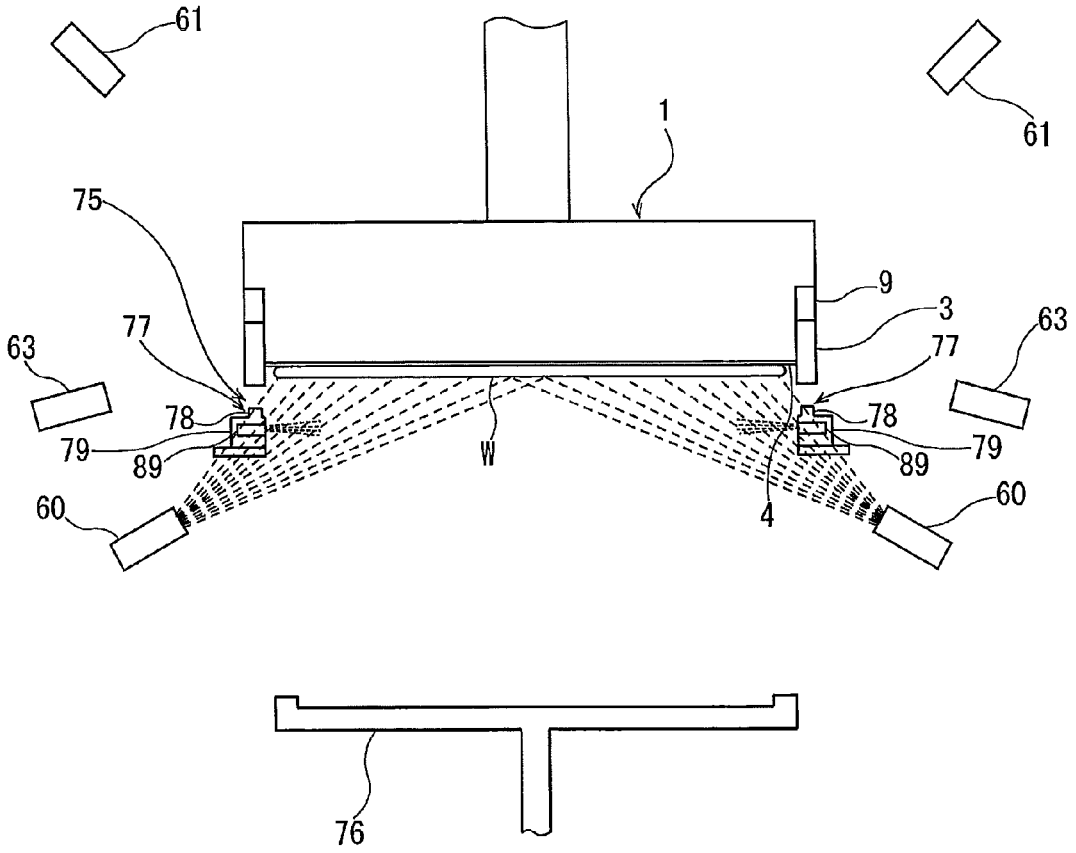
FIG. 15 is a schematic view showing the wafer cleaning operation in still another embodiment.
Figure 16:
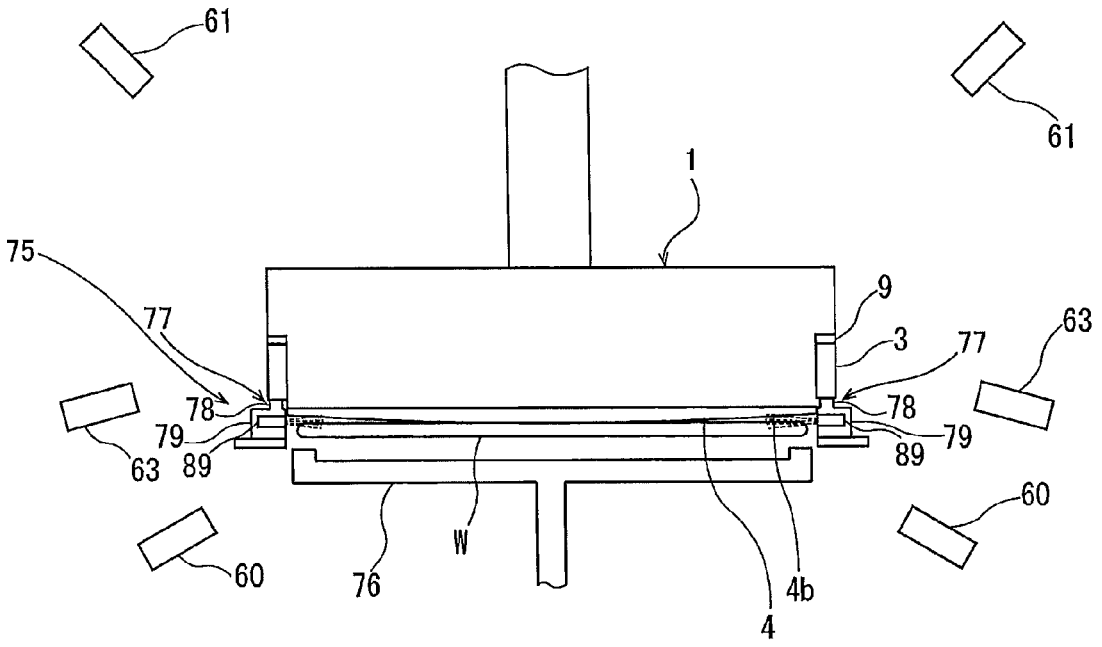
FIG. 16 is a schematic view showing the wafer releasing operation in still another embodiment.
Figure 17:
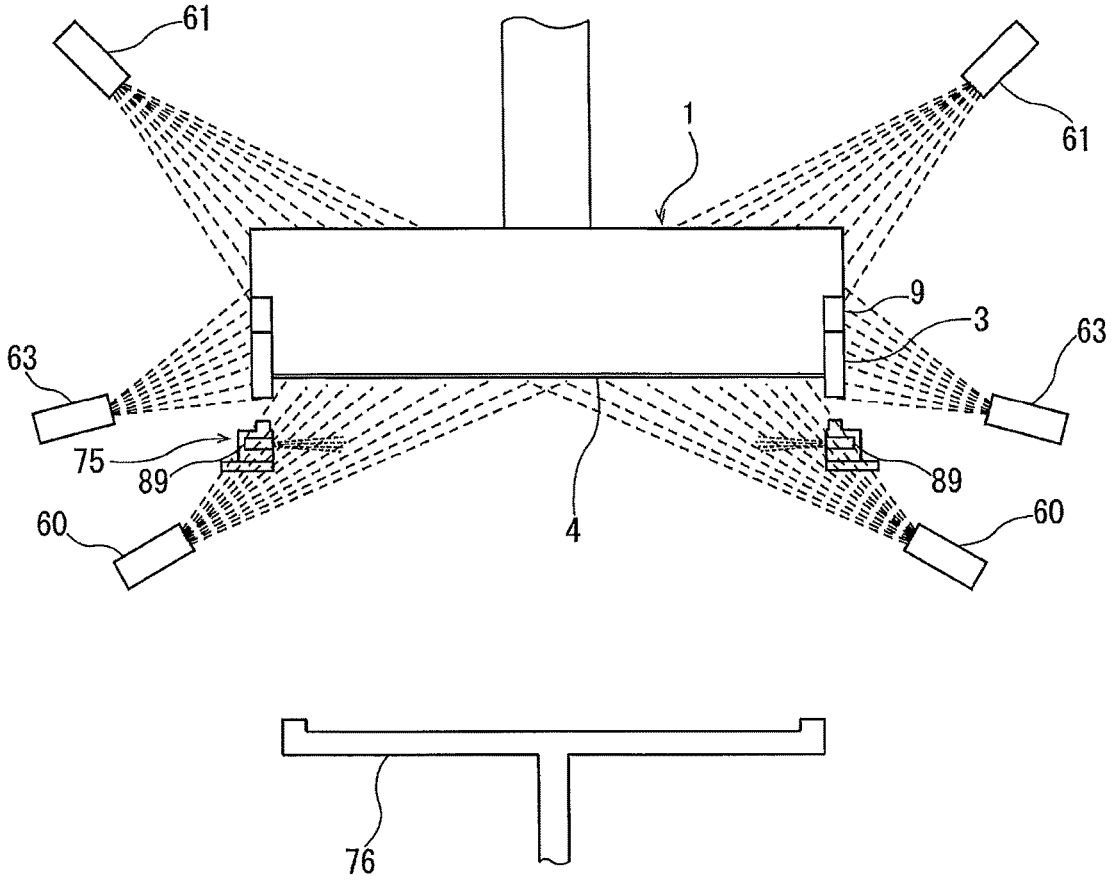
FIG. 17 is a schematic view showing the polishing-head cleaning operation in still another embodiment.

Next, the polishing apparatus according to still another embodiment will be described. FIG. 14 is a schematic view showing the polishing-head moving operation according still another embodiment. FIG. 15 is a schematic view showing the wafer cleaning operation according to still another embodiment. FIG. 16 is a schematic view showing the wafer releasing operation according to still another embodiment. FIG. 17 is a schematic view showing the polishing-head cleaning operation according to still another embodiment.

In the embodiment shown in FIGS. 14 through 17, instead of the pusher 50, a retainer-ring station 75 and a transfer stage 76 are used as the wafer transfer device (substrate transfer device). Other structures in this embodiment are the same as those of the embodiment shown in FIGS. 10 through 12, and the corresponding elements are detonated by the same reference numerals and detailed descriptions thereof are omitted.

A position of the retainer-ring station 75 is fixed, while the transfer stage 76 is movable in the vertical direction. The retainer-ring station 75 includes a plurality of lifting mechanisms 77 configured to lift the retainer ring 3 of the polishing head 1. A position of the lifting mechanisms 77 in the vertical direction is located between the polishing head 1 and the transfer stage 76. Further, the lifting mechanisms 77 and the transfer stage 76 are arranged so as not to interfere with each other.

Each of the lifting mechanisms 77 includes a lift pin 78 configured to contact the retainer ring 40, a spring (not shown) as a pressing mechanism configured to push the lift pin 78 upward, and a casing 79 housing the lift pin 78 and the spring therein. The lifting mechanism 77 is located such that the lift pin 78 faces the lower surface of the retainer ring 3. When the polishing head 1 is lowered, the lower surface of the retainer ring 3 is brought into contact with the lift pins 78. The springs have a pushing force that is large enough to push the retainer ring 3 upward. Therefore, as shown in FIG. 16, the retainer ring 3 is pushed upward by the lift pins 78 and is moved to a position above the wafer W.

The retainer-ring station 75 is provided with a plurality of release nozzles 89. These release nozzles 89 are arranged at predetermined intervals along a circumferential direction of the retainer-ring station 75. Each of the release nozzles 89 is configured to eject a fluid mixture (or releasing shower) of pressurized nitrogen and pure water in a radially inward direction of the retainer-ring station 75.

Next, the wafer releasing operation using the retainer-ring station 75 and the transfer stage 76 will be described. As shown in FIG. 14, the polishing head 1, holding the polished wafer W, is moved to a predetermined position above the retainer-ring station 75. Subsequently, the polishing head 1 is lowered, and as shown in FIG. 16, the retainer ring 3 is pushed upward by the lifting mechanisms 77 of the retainer-ring station 75. While the polishing head 1 is lowered, the transfer stage 76 is elevated and moved to a position just below the polishing head 1 without contacting the retainer ring 3.

In this state, the pressure chamber of the membrane 4 is pressurized at a low pressure (e.g., at most 0.1 MPa) to inflate the membrane 4. As a result, a gap is formed between the peripheral edge of the wafer W and the membrane 4. The releasing shower, comprising the fluid mixture of the pressurized nitrogen and the pure water, is ejected into this gap from the release nozzles 89, thereby releasing the wafer W from the membrane 4. The wafer W is received by the transfer stage 76, and the transfer stage 76 is then lowered together with the wafer W. While the fluid mixture of the pressurized nitrogen and the pure water is used as the releasing shower in this embodiment, the releasing shower may be constituted by only a pressurized gas or only a pressurized liquid, or may be constituted by a pressurized fluid of other combination.

Also in this embodiment using the retainer-ring station 75, in order to prevent the contamination of the release nozzles 89, discharging of the interior self-cleaning fluid from the release nozzles 89 is started before or when the polishing head 1 reaches the predetermined position above the retainer-ring station 75 (see FIG. 14). Preferably, discharging of the interior self-cleaning fluid from the release nozzles 89 is started immediately before the polishing head 1 reaches the predetermined position above the retainer-ring station 75. The interior self-cleaning fluid is, for example, pure water. A fluid mixture of nitrogen and pure water may be used as the interior self-cleaning fluid. Alternatively, nitrogen may be used as the interior self-cleaning fluid. Instead of nitrogen, compressed air may be used.

Further, while the cleaning fluid is ejected toward the wafer from the wafer-cleaning nozzles 60 in the wafer cleaning operation, and while the cleaning fluid is ejected toward the polishing head 1 from the polishing-head cleaning nozzles 61, 63 and the wafer-cleaning nozzles 60 in the polishing-head cleaning operation, the interior self-cleaning fluid is discharged from the release nozzles 89 in order to prevent the contamination of the interiors of the release nozzles 89 (see FIG. 15 and FIG. 17).

Figure 18:
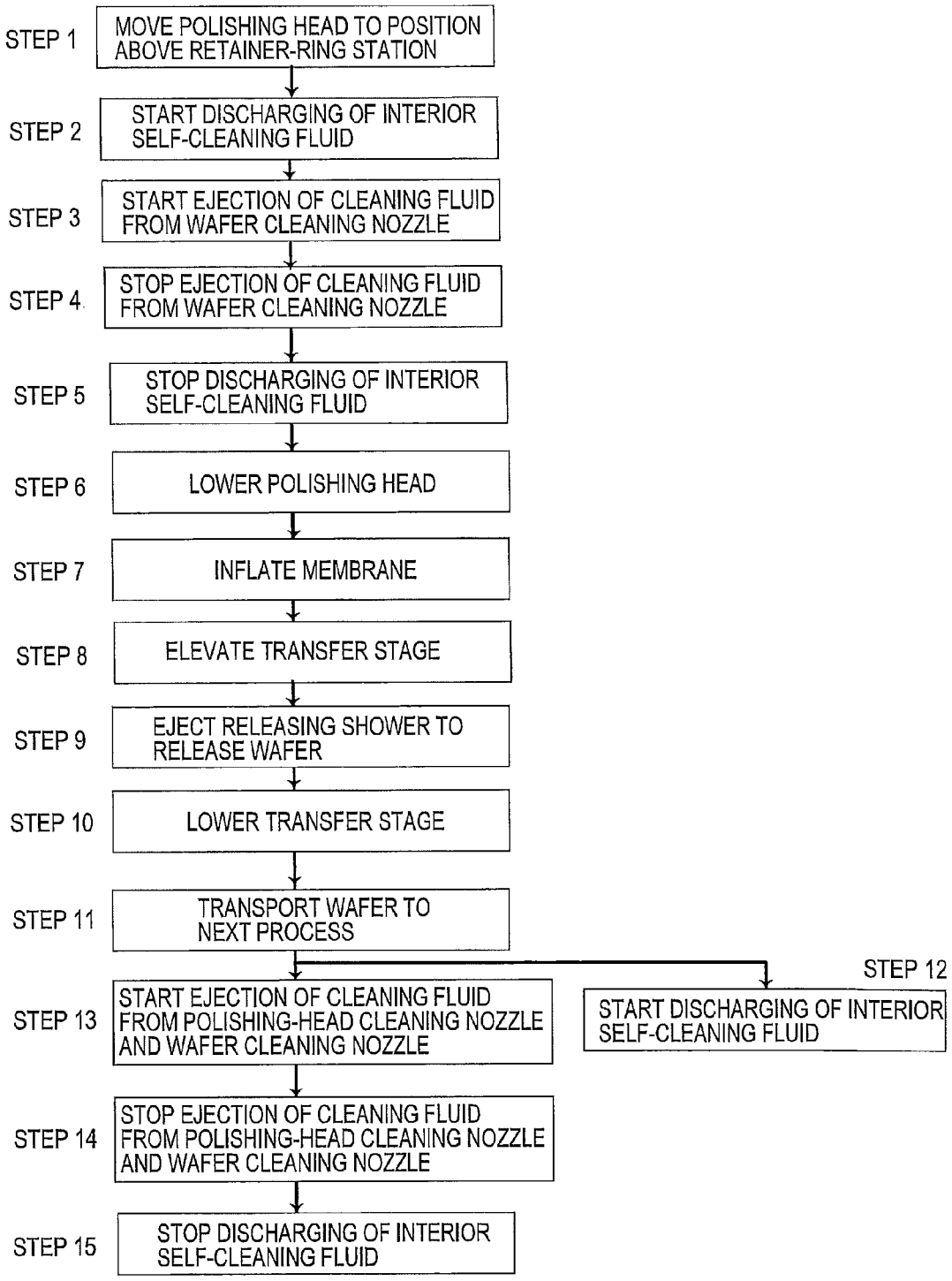
FIG. 18 is a flowchart showing the polishing-head moving operation, the wafer cleaning operation, the wafer releasing operation, and the polishing-head cleaning operation in still another embodiment.

Next, an operation flow according to this embodiment will be described with reference to FIG. 18. As shown in FIG. 18, first, the polishing head 1, holding the polished wafer W, is moved to the predetermined position above the retainer-ring station 75 (step 1). Before the polishing head 1 reaches the predetermined position or when the polishing head 1 has reached the predetermined position, discharging of the interior self-cleaning fluid from the release nozzles 89 is started (step 2). After the movement of the polishing head 1 is completed, the cleaning fluid is ejected toward the polished surface of the wafer W from the wafer-cleaning nozzles 60 (step 3: the wafer cleaning operation). During this wafer cleaning operation, the interior self-cleaning fluid is continuously discharged from the release nozzles 89.

When the ejection of the cleaning fluid from the wafer-cleaning nozzles 60 is stopped (step 4), the wafer cleaning operation is completed.

After the step 4, discharging of the interior self-cleaning fluid from the release nozzles 89 is stopped (step 5). After the step 5, the wafer releasing operation is started. More specifically, the polishing head 1 is lowered together with the wafer W until the retainer ring 3 is brought into contact with the retainer-ring station 75 (step 6), and the pressurized fluid is supplied into the pressure chamber of the membrane 4 to inflate the membrane 4 (step 7), thereby forming the gap between the membrane 4 and the wafer W. Further, the transfer stage 76 is elevated (steep 8). Then, the releasing shower is ejected into the gap between the membrane 4 and the wafer W, thereby releasing the wafer W from the polishing head 1 (step 9). The wafer W is received by the transfer stage 76, and the transfer stage 76 is then lowered together with the wafer W (step 10). When lowering of the transfer stage 76 is completed, the wafer releasing operation is completed. Thereafter, the wafer W is transported to a next process by the transfer stage 76 (step 11).

After the step 11, discharging of the interior self-cleaning fluid from the release nozzles 89 is started again (step 12), and simultaneously with or after this, the cleaning fluid is ejected toward the polishing head 1 from the polishing-head cleaning nozzles 61, 63 and the wafer-cleaning nozzles 60 (step 13: the polishing-head cleaning operation). After the polishing-head cleaning operation is completed, i.e., after the ejection of the cleaning fluid from the polishing-head cleaning nozzles 61, 63 and the wafer-cleaning nozzles 60 is stopped (step 14), discharging of the interior self-cleaning fluid from the release nozzles 89 is stopped (step 15).

Figure 19:
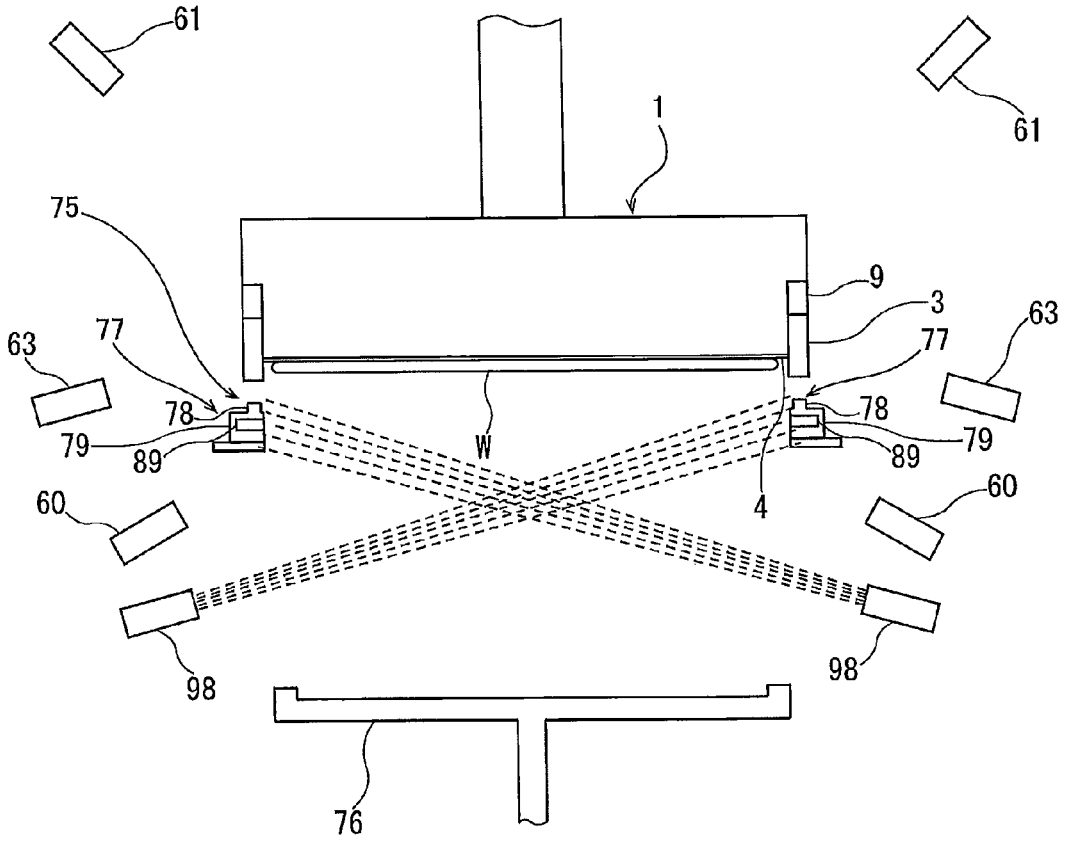
FIG. 19 is a schematic view showing still another embodiment in which release-nozzle cleaning nozzles are provided.

As shown in FIG. 19, the release-nozzle cleaning nozzles 98 for cleaning the release nozzles 89 may be provided. The release-nozzle cleaning nozzles 98 are oriented toward the release nozzles 89, respectively, and are provided in the same number as that of release nozzles 89. An exterior cleaning fluid is ejected toward the release nozzles 89 from the release-nozzle cleaning nozzles 98, so that the exteriors of the release nozzles 89 are cleaned with the exterior cleaning fluid. Pure water is, for example, used as the exterior cleaning fluid.

In the embodiment shown in FIG. 19, the exterior cleaning fluid may be ejected toward the release nozzles 89 without discharging the interior self-cleaning fluid from the release nozzles 89. Alternatively, the exterior cleaning fluid may be ejected toward the release nozzles 89 while discharging the interior self-cleaning fluid from the release nozzles 89. Timings of starting and stopping the ejection of the exterior cleaning fluid are the same as timings of starting and stopping discharging of the interior self-cleaning fluid, and therefore detailed descriptions thereof are omitted.

Figure 20:
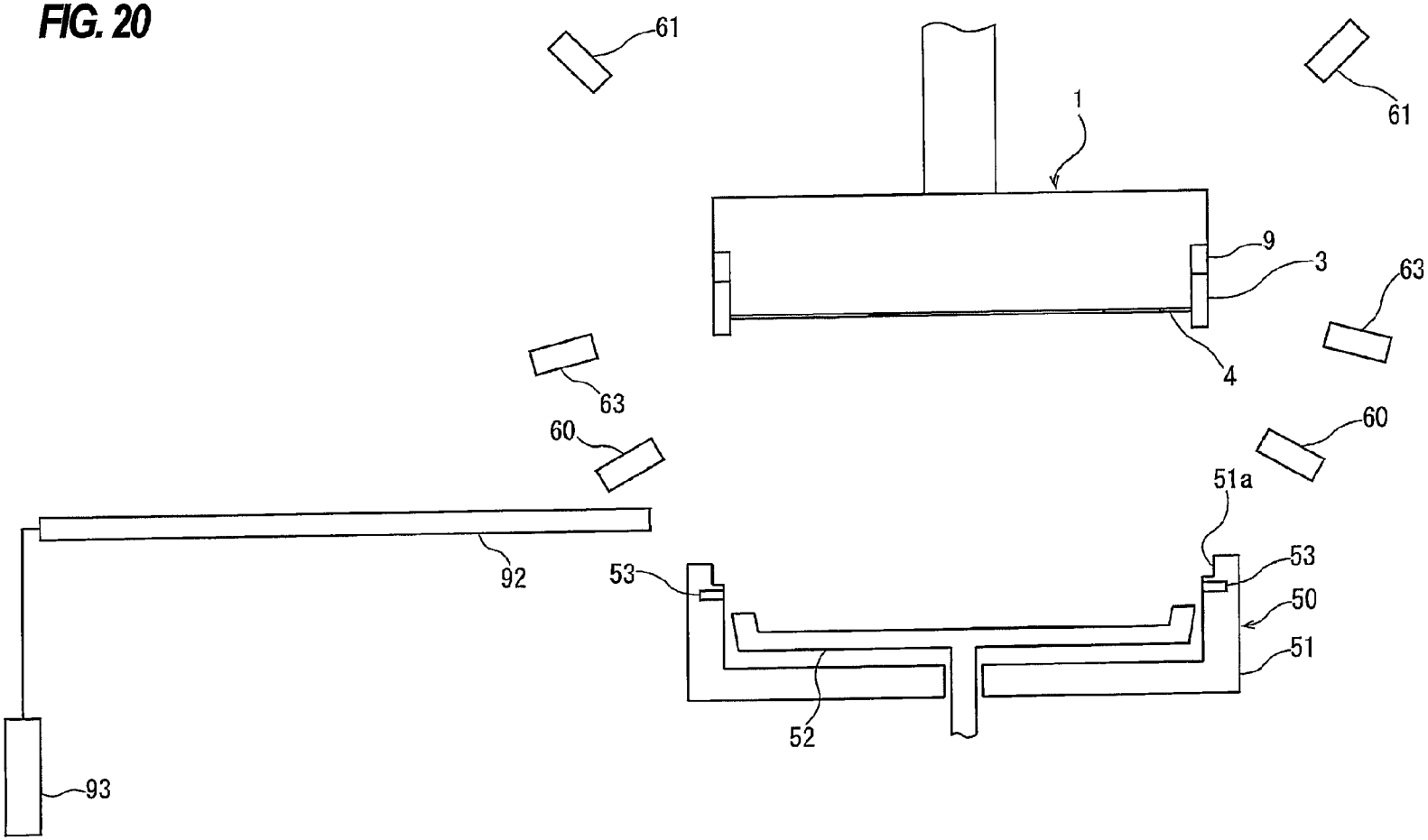
FIG. 20 is a schematic view showing a shutter located at a retreat position in still another embodiment.
Figure 21:
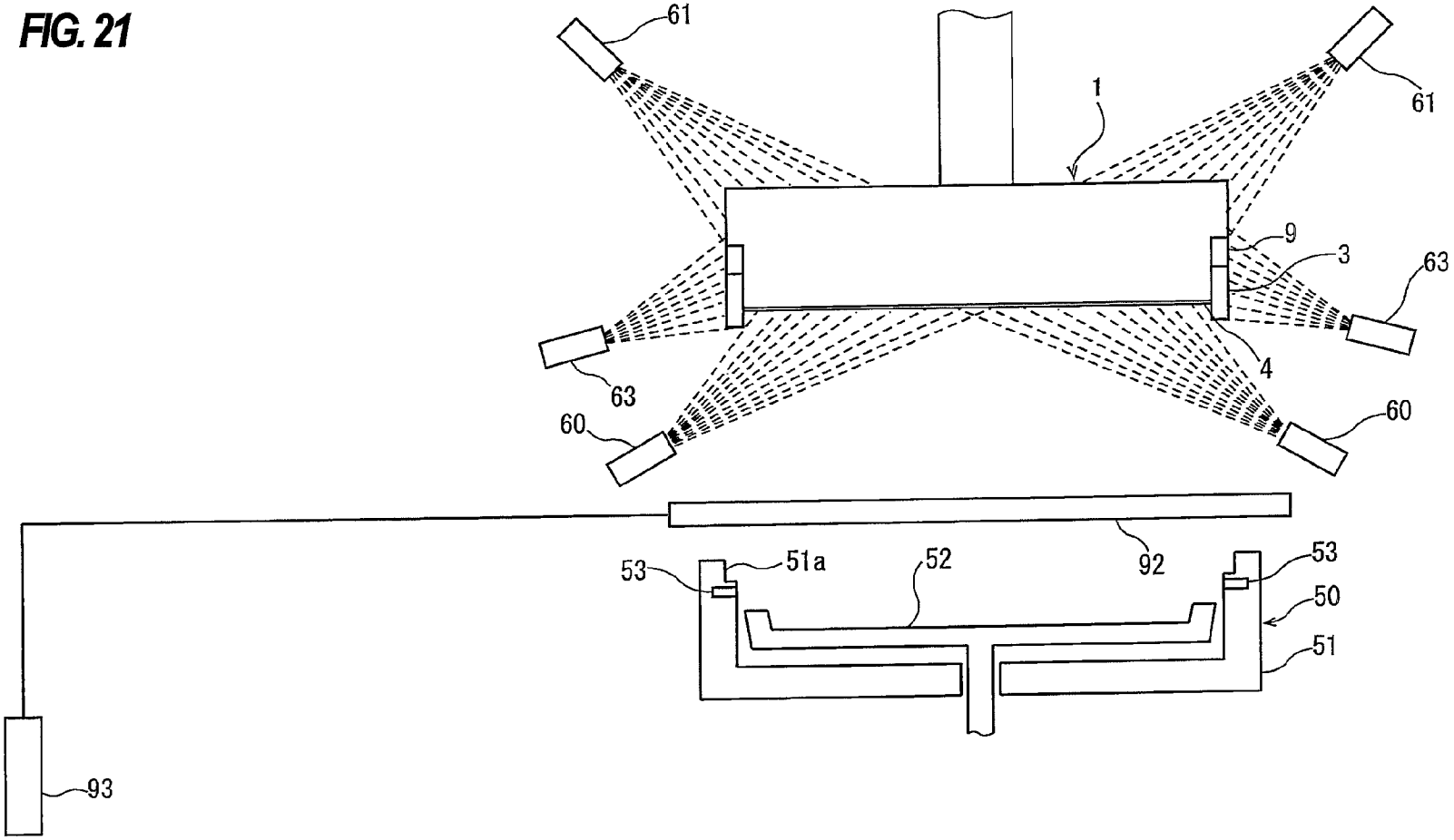
FIG. 21 is a schematic view showing the shutter located at an isolating position in still another embodiment.

Next, with reference to FIG. 20 and FIG. 21, the polishing apparatus according to still another embodiment will be described. The embodiment shown in FIG. 20 and FIG. 21 is a modified example of the embodiment shown in FIGS. 5 through 8. In this embodiment, instead of discharging the interior self-cleaning fluid from the release nozzles 53, a shutter 92 is provided. This shutter 92 is configured to be movable between an isolating position above the release nozzles 53 and a retreat position beside the release nozzles 53. FIG. 20 is a schematic view showing a state in which the shutter 92 is located at the retreat position, and FIG. 21 is a schematic view showing a state in which the shutter 92 is located at the isolating position. FIG. 21 shows a state in which the cleaning fluid is ejected from the wafer-cleaning nozzles 60 and the polishing-head cleaning nozzles 61, 63. As can be seen from FIG. 21, the shutter 92 in the isolating position is located between the release nozzles 53 and the polishing head 1 that has been moved to the predetermined position above the pusher 50.

As shown in FIG. 20 and FIG. 21, in this embodiment, the shutter 92 is capable of covering the entirety of the pusher 50 including the release nozzles 53. The shutter 92 is coupled to an actuator 93, which can move the shutter 92 between the isolating position at which the shutter 92 covers the release nozzles 53 and the retreat position at which a space above the release nozzles 53 is opened. The actuator 93 is, for example, an air cylinder. The shutter 92 may be in a circular disk shape having a diameter larger than a diameter of the pusher 50. When the shutter 92 is at the isolating position, the shutter 92 is located over the release nozzles 53 and the pusher 50 so as to cover the release nozzles 53 and the pusher 50, thereby isolating the release nozzles 53 and the pusher 50 from the polishing head 1.

The shutter 92 is moved from the retreat position to the isolating position before or when the polishing head 1 reaches the predetermined position above the pusher 50, thereby covering the release nozzles 53. The shutter 92 located above the release nozzles 53 can protect the release nozzles 53 from the contaminants, such as the abrasive grains and the polishing debris, which may drop down from the polishing head 1 and the wafer W. As a result, a contamination of a next wafer, onto which the releasing shower is ejected, can be prevented.

The shutter 92 keeps staying at the isolating position to cover the release nozzles 53 while the cleaning fluid is being ejected onto the polished surface of the wafer W from the wafer-cleaning nozzles 60 in the wafer cleaning operation. In addition, the shutter 92 is moved from the retreat position to the isolating position to cover the release nozzles 53 before the cleaning fluid is ejected from the polishing-head cleaning nozzles 61, 63 and the wafer-cleaning nozzles 60 in the polishing-head cleaning operation. In this manner, during the wafer cleaning operation and the polishing-head cleaning operation, the shutter 92 can protect the release nozzles 53 from the cleaning fluid containing the contaminants, such as the abrasive grains and the polishing debris.

Figure 22:
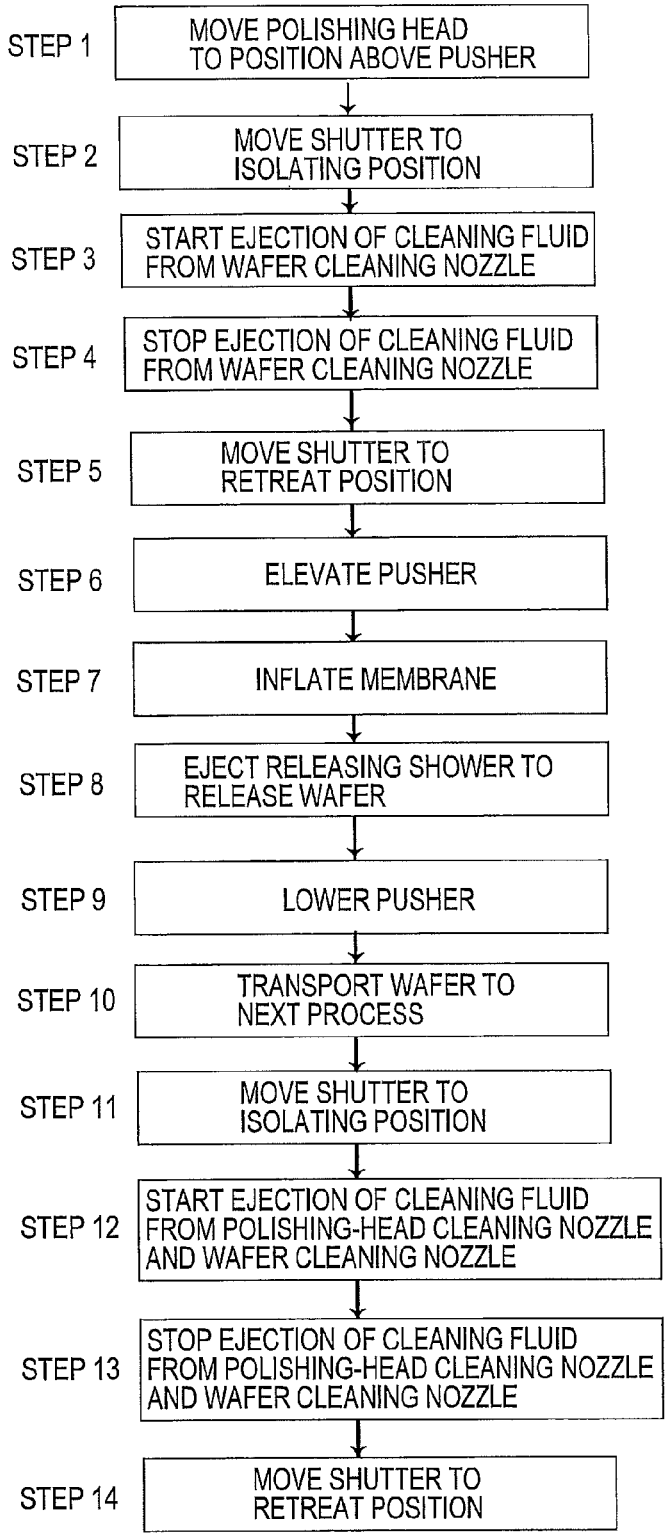
FIG. 22 is a flowchart showing the polishing-head moving operation, the wafer cleaning operation, the wafer releasing operation, and the polishing-head cleaning operation in still another embodiment.

Next, an operation flow, after the wafer W is polished, of the polishing apparatus according to this embodiment will be described with reference to FIG. 22. First, the polishing head 1, holding the polished wafer W, is moved to the predetermined position above the pusher 50 (step 1). The shutter 92 is moved from the retreat position shown in FIG. 20 to the isolating position shown in FIG. 21 (step 2) to cover the release nozzles 53 and the pusher 50, before or when the polishing head 1 reaches the predetermined position. After the movement of the polishing head 1 is completed, the cleaning fluid is ejected from the wafer-cleaning nozzles 60 toward the polished surface of the wafer W (step 3: the wafer cleaning operation). During the wafer cleaning operation, the shutter 92 stays at the isolating position. When the ejection of the cleaning fluid from the wafer-cleaning nozzles 60 is stopped (step 4), the wafer cleaning operation is terminated.

After the step 4, the shutter 92 is moved from the isolating position to the retreat position (step 5). After the step 5, the wafer releasing operation is started. More specifically, the pusher 50 is elevated (step 6), and the pressurized fluid is supplied into the pressure chamber of the membrane 4 to inflate the membrane 4 (step 7), thereby forming the gap between the membrane 4 and the wafer W. The releasing shower is then ejected into the gap between the membrane 4 and the wafer W, thereby releasing the wafer W from the polishing head 1 (step 8). The wafer W is received by the pusher 50, and the pusher 50 is then lowered together with the wafer W (step 9). When lowering of the pusher 50 is completed, the wafer releasing operation is completed. Thereafter, the wafer W, held by the lowered pusher 50, is transferred to a transporter, such as a transfer robot, and is then transported to a next process (step 10).

After the step 10, the shutter 92 is moved from the retreat position to the isolating position (step 11). With the shutter 92 located above the release nozzles 53 and the pusher 50, the cleaning fluid is ejected toward the polishing head 1 from the polishing-head cleaning nozzles 61, 63 and the wafer-cleaning nozzles 60 (step 12: the polishing-head cleaning operation). When the ejection of the cleaning fluid from the polishing-head cleaning nozzles 61, 63 and the wafer-cleaning nozzles 60 is stopped (step 13), the polishing-head cleaning operation is terminated. Thereafter, the shutter 92 is moved from the isolating position to the retreat position (step 14).

Figure 23:
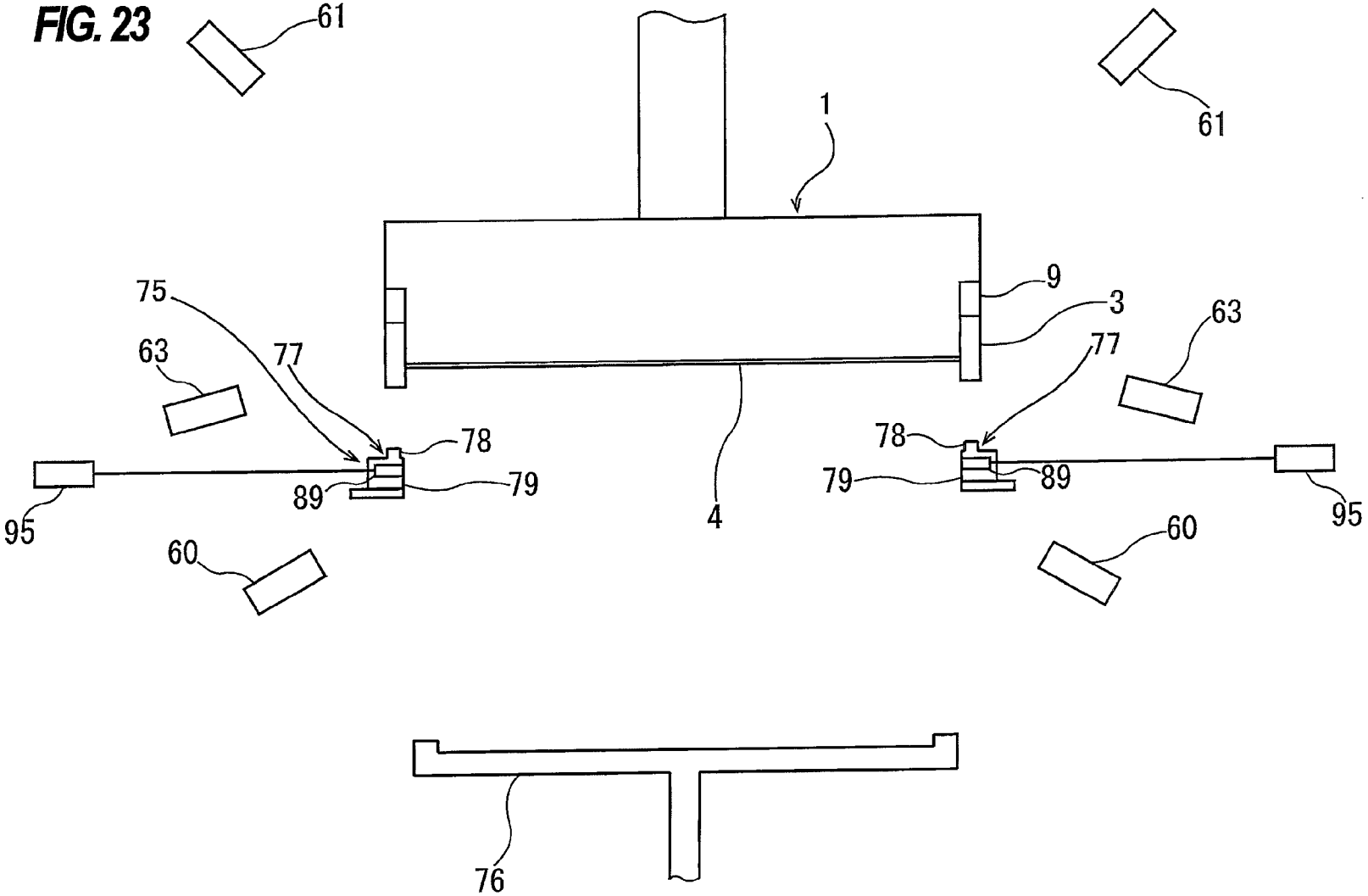
FIG. 23 is a schematic view showing a state in which release nozzles are located at shower positions in still another embodiment.
Figure 24:
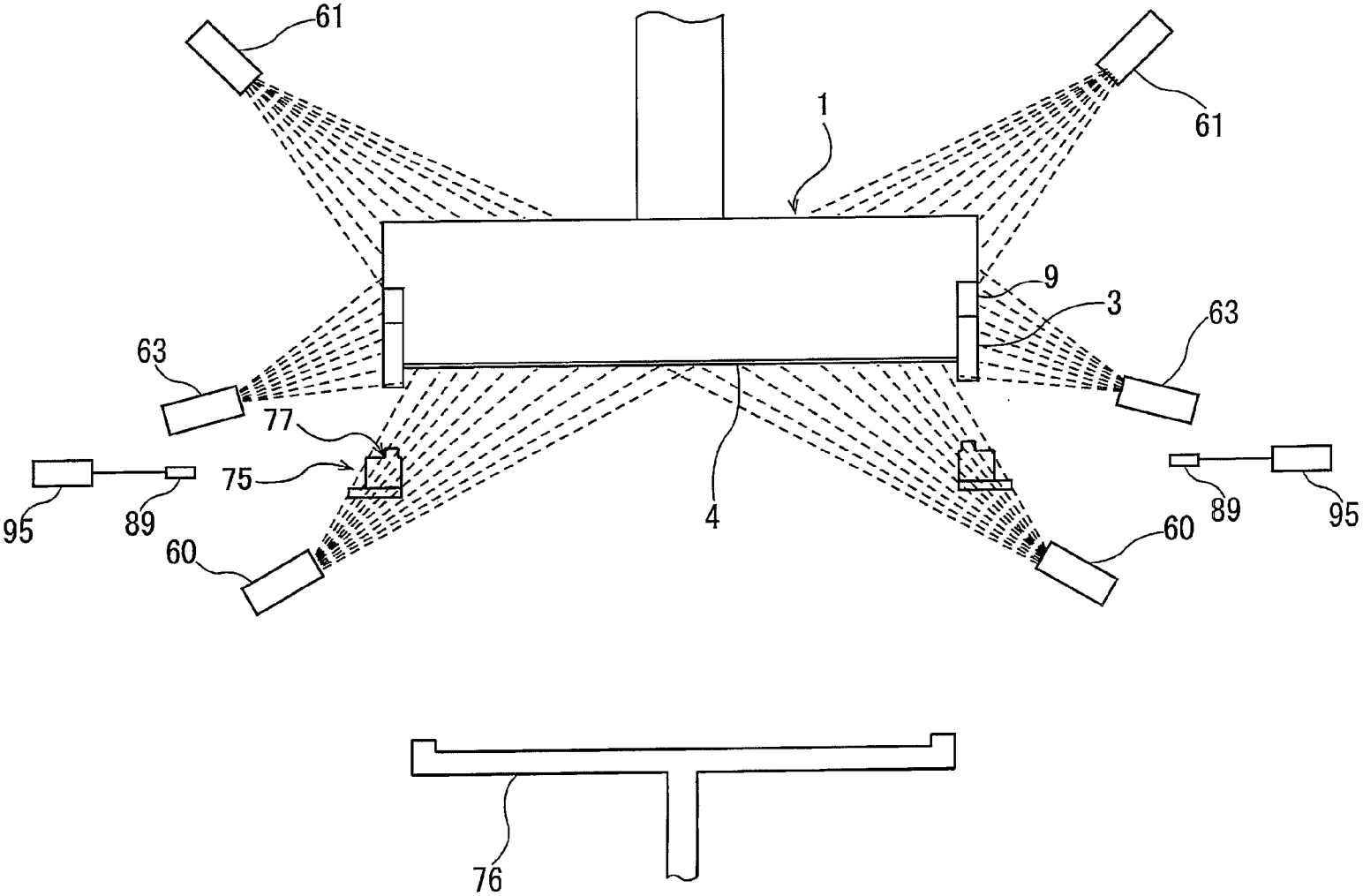
FIG. 24 is a schematic view showing a state in which the release nozzles are located at retreat positions in still another embodiment.

Next, the polishing apparatus according to still another embodiment will be described. The embodiment shown in FIG. 23 and FIG. 24 is a modified example of the embodiment shown in FIGS. 14 through 17. In this embodiment, the release nozzles 89 do not discharge the interior self-cleaning fluid, and the release-nozzle cleaning nozzles 98 are not provided. The release nozzles 89 according to this embodiment are configured to be movable between shower positions for ejecting the releasing shower into the gap between the wafer W and the membrane 4, and retreat positions located away from the retainer-ring station 75. FIG. 23 is a schematic view showing a state in which the release nozzles 89 are located at the shower positions. FIG. 24 is a schematic view showing a state in which the release nozzles 89 are located at the retreat positions, and FIG. 24 shows a state in which the cleaning fluid is ejected toward the polishing head 1 from the wafer-cleaning nozzles 60 and the polishing-head cleaning nozzles 61, 63.

As shown in FIG. 23 and FIG. 24, in this embodiment, the release nozzles 89 are configured to be movable between the shower positions for ejecting the releasing shower into the gap between the wafer W and the membrane 4, and the retreat positions located away the shower positions. The release nozzles 89 are coupled to actuators 95, respectively, and are moved between the shower positions and the retreat positions by the actuators 95. Each of the actuators 95 is, for example, an air cylinder. When the release nozzles 89 are located at the retreat positions, the cleaning fluid ejected from the wafer-cleaning nozzles 60 and the polishing-head cleaning nozzles 61, 63 does not come into contact with the release nozzles 89.

The release nozzles 89 are moved from the shower positions to the retreat positions before or when the polishing head 1 reaches the predetermined position above the retainer-ring station 75. The contaminants, such as the abrasive grains and the polishing debris, which may drop down from the polishing head 1 and the wafer W, do not come into contact with the release nozzles 89 located at the retreat positions. As a result, a contamination of a next wafer, onto which the releasing shower is ejected, can be prevented.

The release nozzles 89 keep staying at the retreat positions while the cleaning fluid is ejected onto the polished surface of the wafer W from the wafer-cleaning nozzles 60 in the wafer cleaning operation. In addition, the release nozzles 89 are moved from the shower positions to the retreat positions before the cleaning fluid is ejected from the polishing-head cleaning nozzles 61, 63 and the wafer-cleaning nozzles 60 in the polishing-head cleaning operation. In this manner, since the release nozzles 89 are located at the retreat positions during the wafer cleaning operation and the polishing-head cleaning operation, the cleaning fluid containing the contaminants, such as the abrasive grains and the polishing debris, do not come into contact with the release nozzles 89. As a result, the contamination of the release nozzles 89 can be prevented. Further, a contamination of a next wafer, onto which the releasing shower is ejected, can be prevented.

Figure 25:
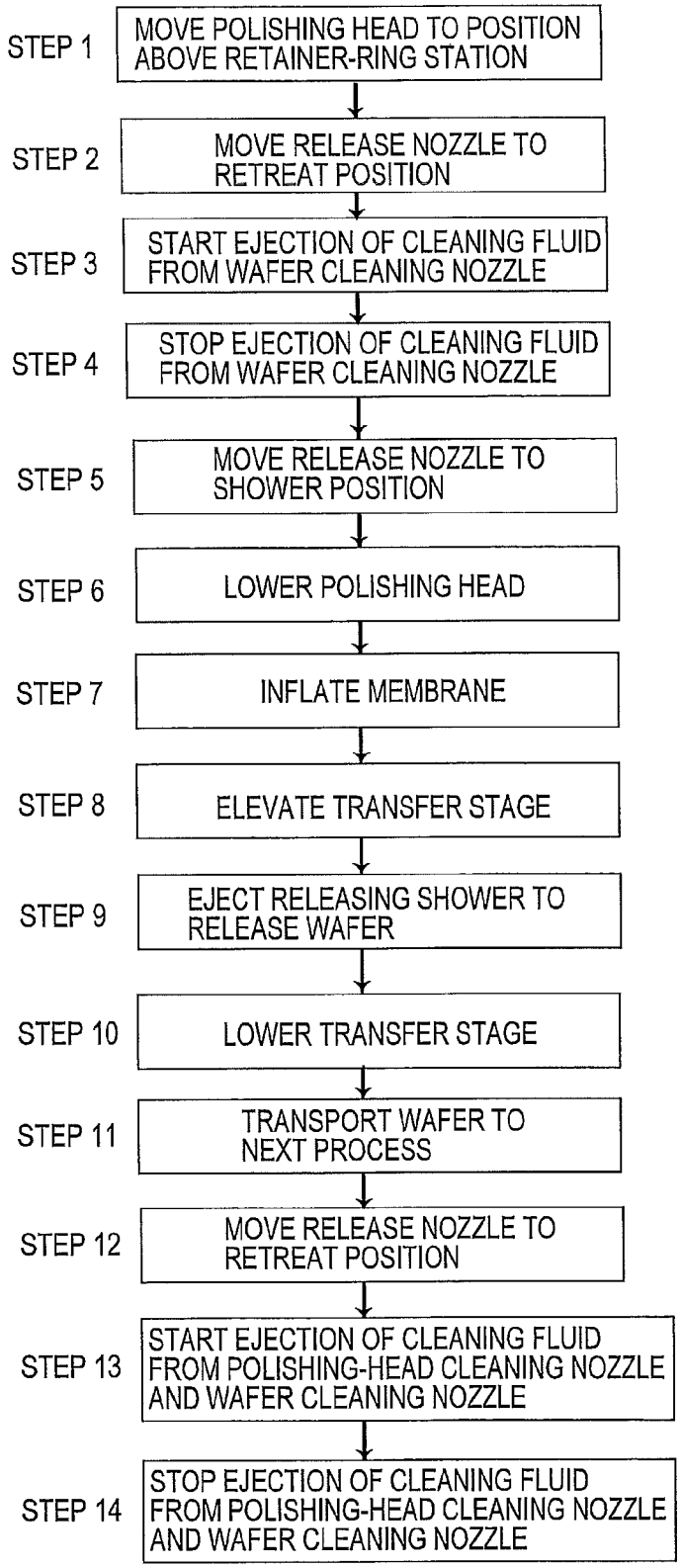
FIG. 25 is a flowchart showing the polishing-head moving operation, the wafer cleaning operation, the wafer releasing operation, and the polishing-head cleaning operation in still another embodiment.

Next, an operation flow, after the wafer W is polished, of the polishing apparatus according to this embodiment will be described with reference to FIG. 25. First, the polishing head 1, holding the polished wafer W, is moved to the predetermined position above the retainer-ring station 75 (step 1). The release nozzles 89 are moved from the shower positions shown in FIG. 23 to the retreat positions shown in FIG. 24 (step 2), before the polishing head 1 reaches the predetermined position or when the polishing head 1 has reached the predetermined position. After the movement of the polishing head 1 is completed, the cleaning fluid is ejected toward the polished surface of the wafer W from the wafer-cleaning nozzles 60 (step 3: the wafer cleaning operation). At this time, the release nozzles 89 stay at the retreat positions. When the ejection of the cleaning fluid from the wafer-cleaning nozzles 60 is stopped (step 4), the wafer cleaning operation is terminated.

After the step 4, the release nozzles 89 are moved from the retreat positions toward the retainer-ring station 75 until they reach the shower positions (step 5). After the step 5, the wafer releasing operation is started. More specifically, the polishing head 1 is lowered together with the wafer W (step 6), and the pressurized fluid is supplied into the pressure chamber of the membrane 4 to inflate the membrane 4 (step 7), thereby forming the gap between membrane 4 and the wafer W. Further, the transfer stage 76 is elevated (step 8). The releasing shower is then ejected into the gap between the membrane 4 and the wafer W, thereby releasing the wafer W from the polishing head 1 (step 9). The wafer W is received by the transfer stage 76, and the transfer stage 76 is then lowered together with the wafer W (step 10). When lowering of the transfer stage 76 is completed, the wafer releasing operation is completed. Thereafter, the wafer W is transported to a next process by the transfer stage 76 (step 11).

After the step 11, the release nozzles 89 are moved from the shower positions to the retreat positions (step 12), and the cleaning fluid is then ejected toward the polishing head 1 from the polishing-head cleaning nozzles 61, 63 and the wafer-cleaning nozzles 60. (step 13: the wafer cleaning operation). When the ejection of the cleaning fluid from the polishing-head cleaning nozzles 61, 63 and the wafer-cleaning nozzles 60 is stopped (step 14), the polishing-head cleaning operation is terminated.

Figure 26:
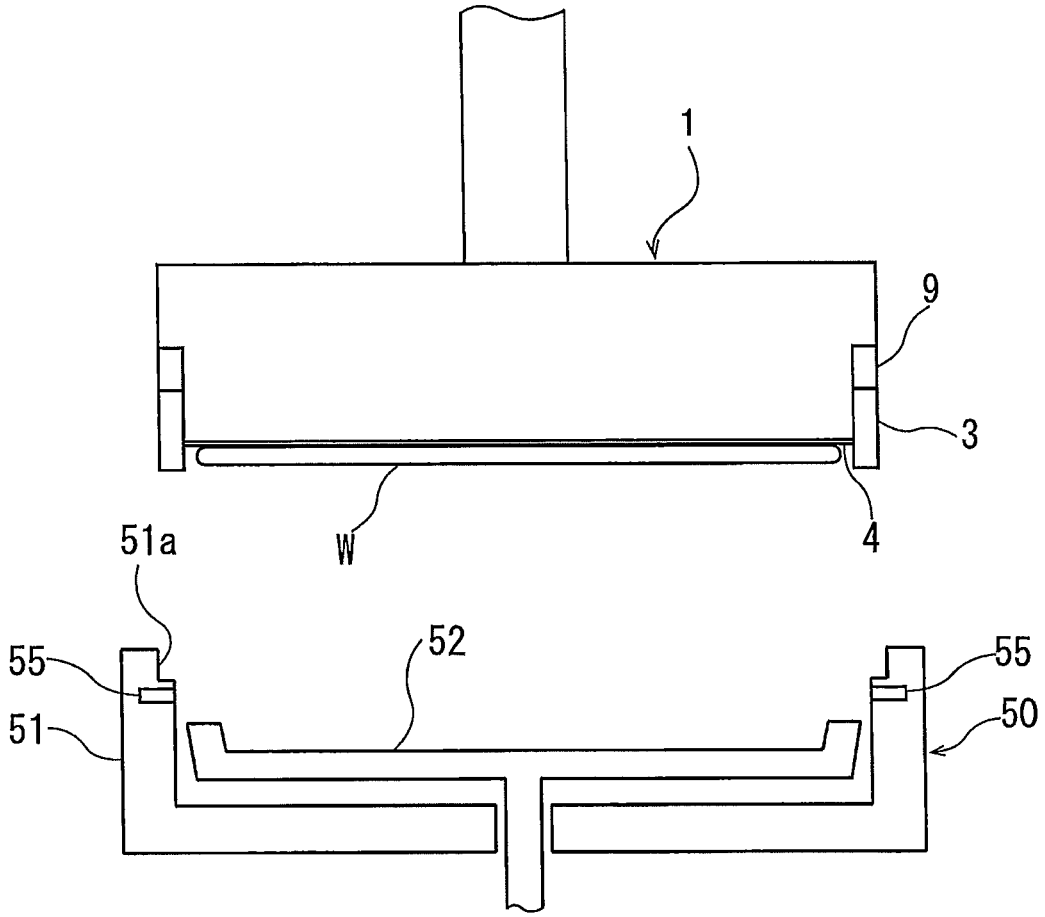
FIG. 26 is a schematic view showing a state in which the polishing head has just been moved to the predetermined position above the pusher in order to transfer the wafer to the pusher.
Figure 27:
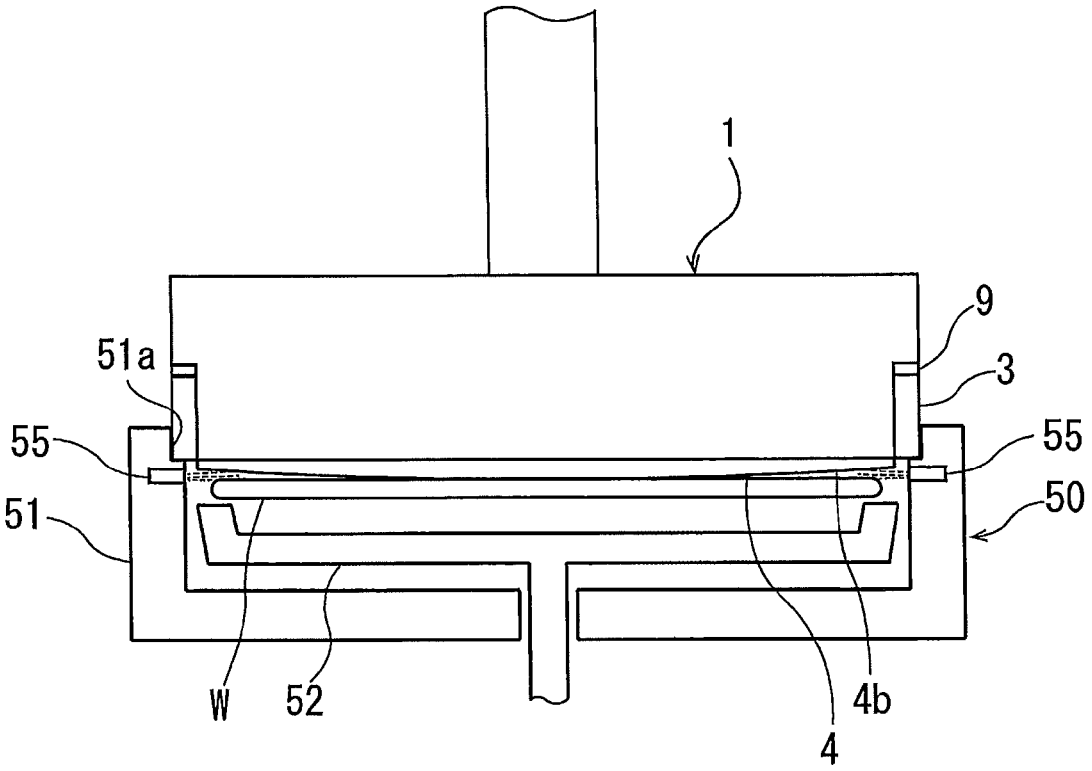
FIG. 27 is a schematic view showing a state in which the pusher is elevated in order for the polishing head to transfer the wafer to the pusher.

Next, still another embodiment of the pusher 50 will be described. Structures and operations, which will not be described particularly in this embodiment, are identical to those of the above-described embodiment shown in FIG. 3 and FIG. 4, and repetitive descriptions thereof are omitted. FIG. 26 is a schematic view a state in which the polishing head 1 has just been moved to the predetermined position above the pusher 50 in order to transfer the wafer W to the pusher 50. FIG. 27 is a schematic view showing a state in which the pusher 50 is elevated in order for the polishing head 1 to transfer the wafer W to the pusher 50.

The pusher 50 is provided with release nozzles 55, which are formed in the polishing-head guide 51, for ejecting a fluid (or a release jet flow). In this embodiment, Each of the release nozzles 55 is constructed as a Laval nozzle which can discharge a supersonic jet flow. The release nozzles 55 are arranged at predetermined intervals along the circumferential direction of the polishing-head guide 51. Each release nozzle 55 is configured to eject the release jet flow, comprising a fluid mixture of pressurized nitrogen and pure water, in the radially inward direction of the polishing-head guide 51.

Next, the wafer releasing operation (substrate releasing operation) for transferring the wafer W from the polishing head 1 to the pusher 50 will be described. After the polishing head 1 is moved to the predetermined position above the pusher 50, the pusher 50 is elevated as shown in FIG. 27 until the outer peripheral surface of the retainer ring 3 is fitted into the annular step 51*a* of the polishing-head guide 51, so that the polishing head 1 is aligned with the pusher 50. At this time, the polishing-head guide 51 pushes the retainer ring 3 upwardly, and at the same time, the vacuum is produced in the retainer-ring pressure chamber 9, thereby elevating the retainer ring 3 rapidly.

When elevating of the pusher 50 is completed, the wafer W and the membrane 4 are exposed, because the bottom surface of the retainer ring 3 is pushed upwardly to a position higher than the lower surface of the membrane 4. Thereafter, vacuum-chucking of the wafer W by the polishing head 1 is stopped, and the wafer release operation is performed. Instead of elevating the pusher 50, the polishing head 1 may be lowered to come into contact with the pusher 50.

When the wafer release operation is performed, the pressure chamber (e.g., the ripple chamber 6) of the membrane 4 is pressurized at a low pressure (e.g., at most 100 hPa) to inflate the membrane 4. As a result, the gap is formed between the peripheral edge of the wafer W and the membrane 4. The release jet flow, comprising the fluid mixture of the pressurized nitrogen and the pure water, is delivered into this gap from the release nozzles 55, thereby releasing the wafer W from the membrane 4. The wafer W is received by the pusher stage 52, and is then transferred from the pusher stage 52 to the transporter, such as a transfer robot. While the fluid mixture of the pressurized nitrogen and the pure water is used as the release jet flow in this embodiment, the release jet flow may be constituted by only a pressurized gas or only a pressurized liquid, or may be constituted by a pressurized fluid of other combination.

Figure 28:
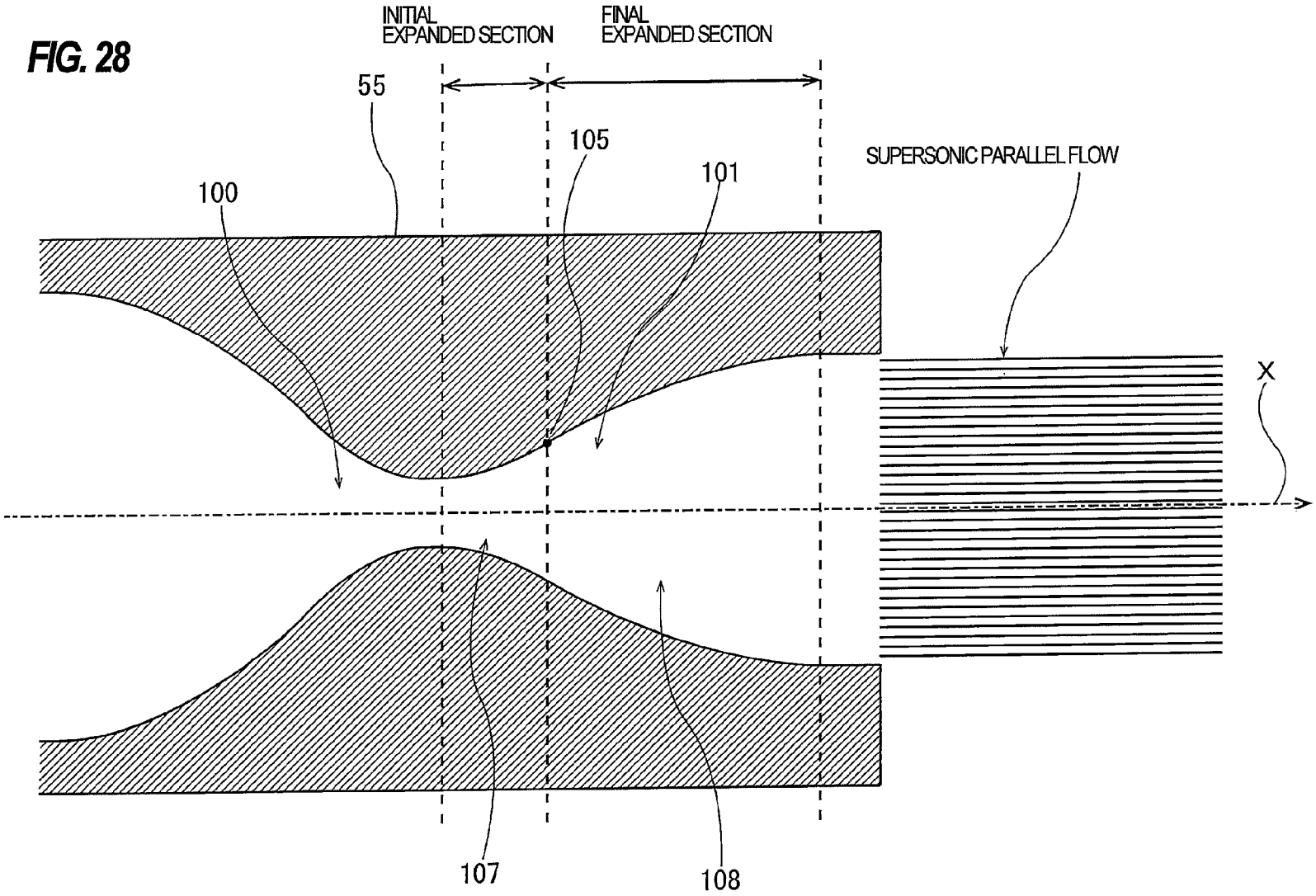
FIG. 28 is an enlarged cross-sectional view of a release nozzle which is constructed as a Laval nozzle.

The release nozzles 55, which are constructed as the Laval nozzles, will be described with reference to FIG. 28. FIG. 28 is an enlarged cross-sectional view of the release nozzle 55 which is constructed as the Laval nozzle. The release nozzle 55 will hereinafter be referred to as the Laval nozzle 55. The Laval nozzle 55 has a throat section 100 whose flow-passage diameter gradually decreases, and an expanded section 101 whose flow-passage diameter gradually increases. The expanded section 101 is located downstream of the throat section 100.

Assuming that the fluid, flowing in the Laval nozzle 55, is a compressible fluid, a flow velocity of the fluid increases, because the flow-passage diameter gradually decreases in the throat section 100. Conditions (e.g., the flow-passage diameter of the throat section 100, the pressure of the fluid, and a flow rate of the fluid) are set such that the fluid forms a choked flow at a position of a minimum flow-passage diameter in the throat section 100. The choked flow is such that the flow velocity of the compressible fluid is in a critical state with Mach number of 1. The compressible fluid is squeezed (i.e., choked) at the position of the minimum flow-passage diameter in the throat section 100, thereby forming the choked flow so that the flow rate of the fluid flowing through the Laval nozzle 55 is restricted. The compressible fluid in the state of the choked flow has a property that the flow velocity thereof increases with an increase in a cross-sectional area of the flow passage. Therefore, the fluid in the state of the choked flow (i.e., the fluid whose flow velocity has reached the speed of sound) is accelerated in the expanded section 101 in which the flow-passage diameter gradually increases. As a result, the flow velocity of the fluid reaches the supersonic velocity.

In order for the release jet flow, ejected from the Laval nozzle 55, to form a stable supersonic parallel flow, a shape of an inner surface of the expanded section 101 of the Laval nozzle 55 is important. Thus, the shape of the inner surface of the expanded section 101 is designed with use of known theories of compressible fluid dynamics (e.g., a method of characteristics, such as Foelsch method, Prandtl-Meyer function). The parallel flow means that the release jet flow is in parallel with a longitudinal direction of the Laval nozzle 55. The longitudinal direction of the Laval nozzle 55 corresponds to a flow direction of the fluid flowing in the Laval nozzle 55. This longitudinal direction corresponds to a central axis of the Laval nozzle 55, and this central axis is denoted by a symbol X in FIG. 28.

In order to form the release jet flow which is the stable supersonic parallel flow, the expanded section 101 has, for example, a smoothly-curved surface according to the Foelsch method. The smoothly-curved surface according to the Foelsch method has an inflection point 105. The expanded section 101 has an initial expanded section 107 located upstream of the inflection point 105. A slope of a tangential line on the curved surface of the initial expanded section 107 gradually increases with the flow direction. Therefore, in an upper half of the Laval nozzle 55 in FIG. 28, a cross-sectional shape of the curved surface in the initial expanded section 107 is a downwardly convex curve, and in a lower half of the Laval nozzle 55, a cross-sectional shape of the curved surface in the initial expanded section 107 is an upwardly convex curve.

The expanded section 101 has a final expanded section 108 located downstream of the inflection point 105. A slope of a tangential line on the curved surface of the final expanded section 108 gradually decreases with the flow direction. Therefore, in the upper half of the Laval nozzle 55 in FIG. 28, a cross-sectional shape of the curved surface in the final expanded section 108 is an upwardly convex curve, and in the lower half of the Laval nozzle 55, a cross-sectional shape of the curved surface in the final expanded section 108 is a downwardly convex curve. The shape of the initial expanded section 107 may be determined from a required Mach number or the like with use of the Prandtl-Meyer function or the like. According to the Foelsch method, the shape of the curved surface in the final expanded section 108 is designed based on the shape of the curved surface in the initial expanded section 107 in such a way that an expansion wave produced in the initial expanded section 107 is cancelled and eliminated by a compression wave produced on a wall of the final expanded section 108. The shapes of the curved surfaces of the initial expanded section 107 and the final expanded section 108 are determined with use of known theories of compressible fluid dynamics.

The Laval nozzle 55 designed in this manner can eject the release jet flow, which is the supersonic parallel flow, into the gap between the wafer W and the membrane 4. The release jet flow can be properly delivered into the gap between the wafer W and the membrane 4 even if the gap is small, because the release jet flow is in the form of parallel flow. As a result, it is not necessary to largely inflate the membrane 4, and it is therefore possible to prevent the rupture of fine interconnects formed on the wafer W and prevent breakage of the wafer W. Further, particles, which exist around the release jet flow, cannot follow the release jet flow, because the release jet flow has the supersonic velocity. As a result, the release jet flow does not adsorb the particles, and therefore does not contaminate the wafer W. Further, since the release jet flow has the supersonic velocity, a dynamic pressure of the release jet flow can be increased. As a result, releasing of the wafer W is accelerated, and a throughput of the polishing operation can be increased.

Figure 29:
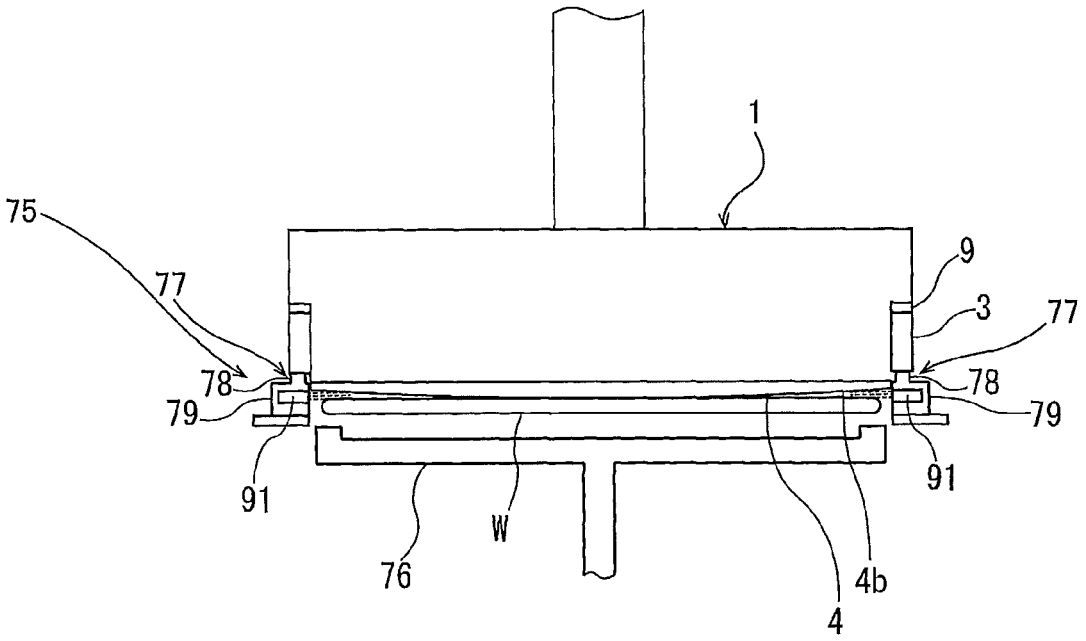
FIG. 29 is a schematic view of an embodiment of the polishing apparatus in which, instead of the pusher, a retainer-ring station and a transfer stage are provided as a substrate transfer device.

FIG. 29 is a schematic view an embodiment of the polishing apparatus in which, instead of the pusher, the retainer-ring station and the transfer stage are provided as the substrate transfer device. Structures, which will not be described particularly in this embodiment, are identical to those of the embodiment shown in FIGS. 14 through 16, the corresponding elements are detonated by the same reference numerals, and detailed descriptions thereof are omitted.

The retainer-ring station 75 is provided with a plurality of release nozzles 91 which are the Laval nozzles. These release nozzles 91 are arranged at predetermined intervals along the circumferential direction of the retainer-ring station 75. Each of the release nozzles 91 is configured to eject the fluid mixture (the release jet flow) of pressurized nitrogen and pure water in the radially inward direction of the retainer-ring station 75.

Next, the wafer releasing operation with use of the retainer-ring station 75 and the transfer stage 76 will be described. The polishing head 1, holding the polished wafer W, is moved to the predetermined position above the retainer-ring station 75. The polishing head 1 is then lowered until the retainer ring 3 is pushed upwardly by the lifting mechanisms 77 of the retainer-ring station 75 as shown in FIG. 29. While the polishing head 1 is lowered, the transfer stage 76 is elevated and moved to the position just below the polishing head 1 without contacting the retainer ring 3.

In this state, the pressure chamber of the polishing head 1 is pressurized at a low pressure to inflate the membrane 4. As a result, the gap is formed between the peripheral edge of the wafer W and the membrane 4. The release jet flow, comprising the fluid mixture of pressurized nitrogen and pure water, is delivered from the release nozzles 91 into this gap, thereby releasing the wafer W from the membrane 4. The wafer W is received by the transfer stage 76, and the transfer stage 76 is then lowered together with the wafer W. While the fluid mixture of the pressurized nitrogen and the pure water is used as the release jet flow in this embodiment, the release jet flow may be constituted by only a pressurized gas or only a pressurized liquid, or may be constituted by a pressurized fluid of other combination.

Also in this embodiment shown in FIG. 29, the release nozzles 91 are constructed as the Laval nozzles shown in FIG. 28. More specifically, each of the Laval nozzles 91 has the throat section 100 whose flow-passage diameter gradually decreases, and has the expanded portion 101 whose flow-passage diameter gradually increases. The expanded portion 101 is located downstream of the throat section 100. As described above, the release nozzles 91 constructed as the Laval nozzles can eject the release jet flow, which is the supersonic parallel flow, into the gap between the wafer W and the membrane 4.

The release nozzles 55 which are the above-described Laval nozzles can be applied to the embodiment shown in FIGS. 5 through 13. More specifically, in the embodiment shown in FIGS. 5 through 13, instead of the release nozzles 53, the release nozzles 55 which are the Laval nozzles may be used. Similarly, the release nozzles 91 which are the above-described Laval nozzles can be applied to the embodiment shown in FIGS. 14 through 25. More specifically, in the embodiment shown in FIGS. 14 through 25, instead of the release nozzles 89, the release nozzles 91 which are the Laval nozzles may be used.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A polishing method comprising:

polishing a substrate by pressing the substrate against a polishing pad on a polishing table by a polishing head while moving the polishing table and the polishing head relative to each other;

moving the polishing head, holding the substrate, to a predetermined position above a substrate transfer device;

cleaning the substrate by ejecting a cleaning fluid onto the substrate held by the polishing head located at the predetermined position;

during cleaning of the substrate, discharging a fluid from a release nozzle located at the substrate transfer device; and after cleaning of the substrate, releasing the substrate from the polishing head by ejecting a releasing shower from the release nozzle into a gap between the polishing head and the substrate.

2. The polishing method according to claim 1, further comprising:

after releasing of the substrate from the polishing head, cleaning the polishing head by ejecting a cleaning fluid onto the polishing head.

3. The polishing method according to claim 2, further comprising:

during cleaning of the polishing head, discharging a fluid from the release nozzle.

4. The polishing method according to claim 1, wherein discharging of the fluid from the release nozzle is started before or when the polishing head reaches the predetermined position.

5. The polishing method according to claim 1, wherein:

the release nozzle is a Laval nozzle; and releasing the substrate comprising releasing the substrate from the polishing head by ejecting a supersonic parallel flow from the Laval nozzle into the gap between the polishing head and the substrate after cleaning of the substrate.

6. A polishing method comprising:

polishing a substrate by pressing the substrate against a polishing pad on a polishing table by a polishing head while moving the polishing table and the polishing head relative to each other;

moving the polishing head, holding the substrate, to a predetermined position above a substrate transfer device;

cleaning the substrate by ejecting a cleaning fluid onto the substrate held by the polishing head located at the predetermined position;

during cleaning of the substrate, ejecting a fluid toward a release nozzle located at the substrate transfer device; and after cleaning of the substrate, releasing the substrate from the polishing head by ejecting a releasing shower from the release nozzle into a gap between the polishing head and the substrate.

7. The polishing method according to claim 6, further comprising:

after releasing of the substrate from the polishing head, cleaning the polishing head by ejecting a cleaning fluid onto the polishing head.

8. The polishing method according to claim 7, further comprising:

during cleaning of the polishing head, ejecting a fluid toward the release nozzle.

9. The polishing method according to claim 6, wherein ejecting of the fluid toward the release nozzle is started before or when the polishing head reaches the predetermined position.

10. The polishing method according to claim 6, wherein:

the release nozzle is a Laval nozzle; and releasing the substrate comprising releasing the substrate from the polishing head by ejecting a supersonic parallel flow from the Laval nozzle into the gap between the polishing head and the substrate after cleaning of the substrate.

11. A polishing method comprising:

polishing a substrate by pressing the substrate against a polishing pad on a polishing table by a polishing head while moving the polishing table and the polishing head relative to each other;

moving the polishing head, holding the substrate, to a predetermined position above a substrate transfer device;

moving a shutter to a position above a release nozzle to cover the release nozzle which is located at the substrate transfer device;

cleaning the substrate by ejecting a cleaning fluid onto the substrate held by the polishing head located at the predetermined position, while the shutter is covering the release nozzle;

after cleaning of the substrate, moving the shutter to a retreat position away from the release nozzle; and then releasing the substrate from the polishing head by ejecting a releasing shower from the release nozzle into a gap between the polishing head and the substrate.

12. The polishing method according to claim 11, further comprising:

after releasing of the substrate from the polishing head, cleaning the polishing head by ejecting a cleaning fluid onto the polishing head.

13. The polishing method according to claim 12, further comprising:

before cleaning of the polishing head, moving the shutter to a position above the release nozzle to cover the release nozzle.

14. The polishing method according to claim 11, wherein the shutter is moved to the position above the release nozzle to cover the release nozzle before or when the polishing head reaches the predetermined position.

15. The polishing method according to claim 11, wherein:

the release nozzle is a Laval nozzle; and releasing the substrate comprising releasing the substrate from the polishing head by ejecting a supersonic parallel flow from the Laval nozzle into the gap between the polishing head and the substrate.

16. A polishing method comprising:

polishing a substrate by pressing the substrate against a polishing pad on a polishing table by a polishing head while moving the polishing table and the polishing head relative to each other;

moving the polishing head, holding the substrate, to a predetermined position above a substrate transfer device;

moving a release nozzle, which is located at the substrate transfer device, to a retreat position away from the substrate transfer device;

cleaning the substrate by ejecting a cleaning fluid onto the substrate held by the polishing head located at the predetermined position, while the release nozzle is located at the retreat position;

after cleaning of the substrate, moving the release nozzle from the retreat position to a shower position; and then releasing the substrate from the polishing head by ejecting a releasing shower from the release nozzle into a gap between the polishing head and the substrate.

17. The polishing method according to claim 16, further comprising:

after releasing of the substrate from the polishing head, cleaning the polishing head by ejecting a cleaning fluid onto the polishing head.

18. The polishing method according to claim 17, further comprising:

before cleaning of the polishing head, moving the release nozzle to the retreat position.

19. The polishing method according to claim 16, wherein the release nozzle is moved to the retreat position before or when the polishing head reaches the predetermined position.

20. The polishing method according to claim 16, wherein:

the release nozzle is a Laval nozzle; and releasing the substrate comprising releasing the substrate from the polishing head by ejecting a supersonic parallel flow from the Laval nozzle into the gap between the polishing head and the substrate.

* * * * *